US007999755B2

(12) United States Patent
Licul et al.

(10) Patent No.: US 7,999,755 B2
(45) Date of Patent: Aug. 16, 2011

(54) METHOD AND APPARATUS FOR QUADRIFILAR ANTENNA WITH OPEN CIRCUIT ELEMENT TERMINATIONS

(75) Inventors: Stanislav Licul, Damascus, MD (US); Jeremy Marks, Atlanta, GA (US); Warren L. Stutzman, Dublin, VA (US)

(73) Assignee: Maxtena LLC, Bethesda, MD (US)

( * ) Notice: Subject to any disclaimer, the term of this patent is extended or adjusted under 35 U.S.C. 154(b) by 920 days.

(21) Appl. No.: 11/952,461

(22) Filed: Dec. 7, 2007

(65) Prior Publication Data

US 2008/0174501 A1 Jul. 24, 2008

Related U.S. Application Data

(60) Provisional application No. 60/869,242, filed on Dec. 8, 2006.

(51) Int. Cl.
*H01Q 1/36* (2006.01)
*H01Q 23/00* (2006.01)

(52) U.S. Cl. ..... 343/853; 343/895

(58) Field of Classification Search ..... 343/850, 343/852, 853, 860, 862, 895; 333/25, 26, 333/32, 124, 136

See application file for complete search history.

(56) References Cited

U.S. PATENT DOCUMENTS

| | | | | |
|---|---|---|---|---|
| 5,872,549 | A | 2/1999 | Huynh et al. | |
| 6,421,028 | B1 * | 7/2002 | Ohgren et al. | 343/895 |
| 2004/0017328 | A1 * | 1/2004 | Merrill | 343/895 |

OTHER PUBLICATIONS

PCT—Written Opinion of the International Searching Authority, dated Nov. 6, 2008.

* cited by examiner

*Primary Examiner* — Jacob Y Choi
*Assistant Examiner* — Robert Karacsony
(74) *Attorney, Agent, or Firm* — Laurence E. Stein, Esq.

(57) ABSTRACT

A quadrifilar antenna having helical windings is fed by a phase shift feed network, each winding having an open circuit termination element, the phase shift feeding network having forward directional phase shift paths from a feed input to phase shift feed output ports, and having a first reverse directional transmission path from one or more of the phase shift feed output ports back to a first isolation port, and a second reverse directional transmission path from another one or more of the phase shift feed output ports back to a second isolation port, the first and second isolation ports isolated from the forward directional phase shift paths, and a differential termination impedance, floating from ground, connected the first and second isolation ports. Optionally, the differential termination impedance is frequency selective.

9 Claims, 13 Drawing Sheets

PRIOR ART

PRIOR ART

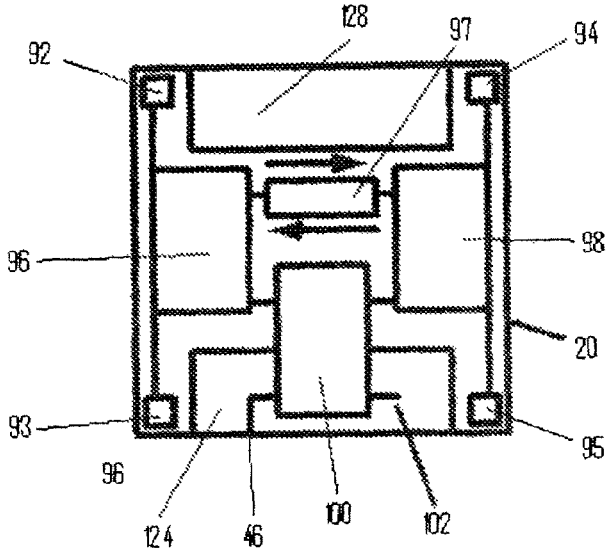
11
FIGURE
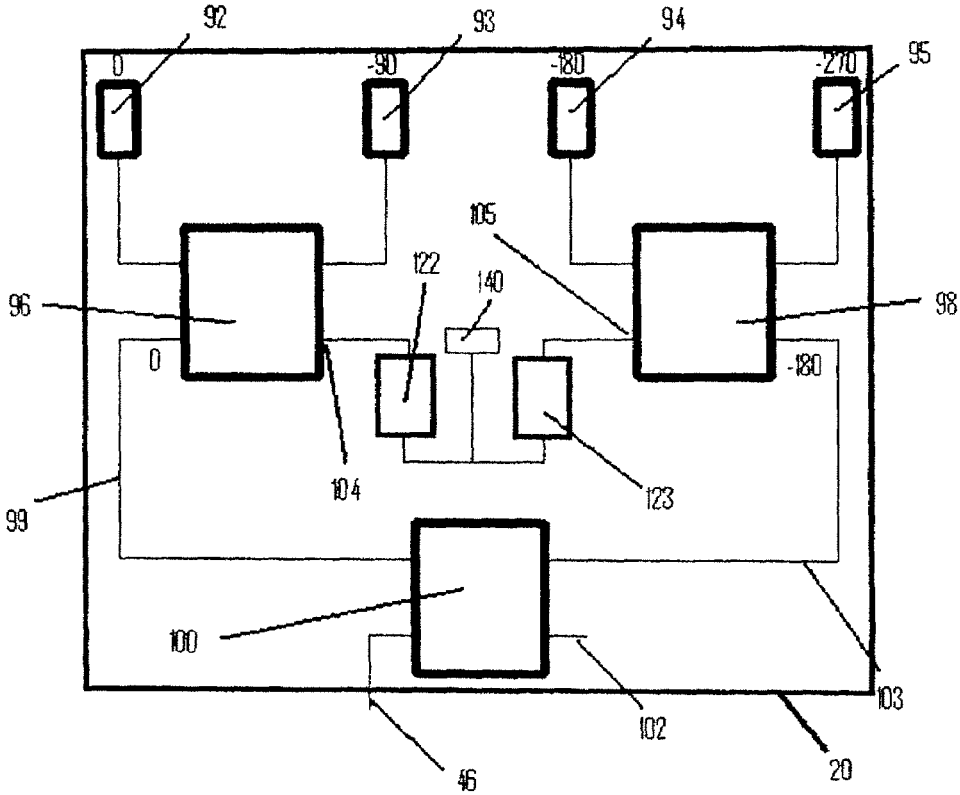
FIGURE 15

FIG. 12A

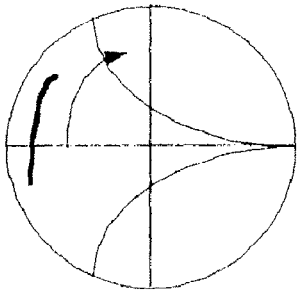

-Antenna impedance (Z1) considering only diameter, height, and pitch angle of the structure

FIG. 12B

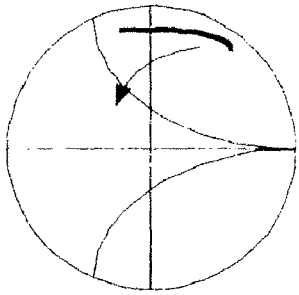

-By introducing the phase shifter board parastics the antenna impednace (Z2) is rotated in clock-wise direction

FIG. 12

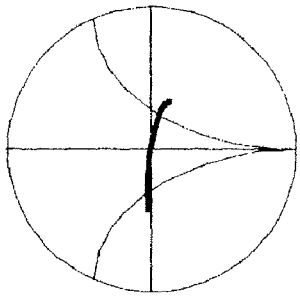

-By introducing capacative or inductive one-stage matching the antenna impedance (Z3) is rotated downward Antenna impedance control using antenna geometry, phase shifter parasitic technique, and one-stage matching technique (Smith Chart Representation)

ISO Port Tuning Setup using Vector Network Analyzer (VNA)

Typical magnitude and phase ISO port response and the effects of capacitance and inductance on the antenna resonant frequency

FIGURE
18

METHOD AND APPARATUS FOR QUADRIFILAR ANTENNA WITH OPEN CIRCUIT ELEMENT TERMINATIONS

CROSS-REFERENCE TO RELATED APPLICATIONS

This application claims priority to U.S. Provisional Application Ser. No. 60/869,242, filed Dec. 8, 2006, which is hereby incorporated by reference.

FIELD OF THE INVENTION

The invention relates to antenna and, more particularly, quadrifilar antenna having helical conductor elements.

BACKGROUND OF THE INVENTION

Demand for smaller, higher performance, simpler and cheaper antennas continues to increase. The demand is due to multiple factors. One is that terminals for satellite communications and other wireless applications are becoming smaller. Another factor is that crowding of antennas continues to increase, both in space and frequency, increasing demand for improved antenna selectivity, in polarity and frequency. Further, power budgets are becoming tighter, which increases demand for higher transmitter/antenna efficiency. Further, particularly for hand held devices—as these tend to move relative to human bodies—demand for antennas that do not require a separate ground plane, and/or that do not require sharing of other components for an effective ground plane is increasing.

Many of these demands have been met, for approximately the last three decades, by related art fractional-turn quadrifilar helical antenna (QHA). As known, related art QHA have circular polarization, good ground-plane independence, a typically acceptably low backlobe, and a reasonably small size.

Related art QHA are known and, therefore, a detailed description of their theory of operation is omitted. Various structures of related art QHA are also known and, therefore, a detailed description of each is omitted. One example typical related art QHA has two spatially orthogonal bifilar helix loops that are balun-fed, typically at one end, and the helix loops being fractional turn (one-fourth to one wavelength) and having a large pitch angle. The helical elements of related art QHA are open or short circuited, typically at the end opposite the feed end, depending on whether the elements are multiples of one-quarter or one-half wavelength, respectively. The radiation pattern of related art QHA is off the end of the antenna, in a broad beam, cardioid shape.

In one related art QHA arrangement, the feed passes through the central axis of the cylinder supporting the conducting arms to drive the helical arms from the top of the QHA. The radiation in this arrangement is in a direction behind the feed, hence the name backfire antenna.

The theory and structure of prior art QHA is known and is described in many publications available to persons skilled in the art. See, for example, R. C. Johnson, "Antenna Engineering Handbook," Third Edition, John Wiley, pp. 13-19 to 13-20 (1993).

FIGS. 1-3 illustrate examples of prior art QHA structures and FIGS. 4 and 5 illustrate examples of prior art QHA feeding circuits.

Referring to FIG. 1 shows a prior art QHA arrangement disclosed in U.S. Pat. No. 6,369,776, issued Apr. 9, 2002 to O. Leisten et al. ("the '776 patent"), with reference numbers added, comprising a feeding region arranged as the depicted region 1, a ceramic core (not labeled) having a height, an integrated balun 2 formed of an outer feed conductor 4A connecting to a first pair (not separately numbered) of helical radiating element arms 3A, and having an inner feed conductor 4B connecting to a second pair (not separately numbered) of helical radiating element arms 3A. The helical radiating elements 3A are not equally spaced. The two pairs of helical radiating element arms extend downward (relative to the orientation of the Figure) an axial length from the feeding region 1 to a shorted arms region 3B. A coaxial antenna feed connection 4C extends from the bottom of the core and up through a center portion (not shown) of the core, exiting at the feeds 4A and 4B. The present inventors observe it is known in the art that the electrical path of the elements 3A is $\lambda/2$ at the operating wavelength, and known that the balun electrical length is ~4 at the operating frequency of the antenna. The present inventors have further identified that the height of the FIG. 1 prior art antenna is driven, in part, by the size of the balun.

Prior Art FIG. 2 shows another example prior art QHA, which is taught by U.S. Patent Publication US2006/0082517A1, naming S. Chung and Y. Wang as inventors, showing a U.S. filing date of Nov. 17, 2005 ("the Chung et al. '517 application"). Referring to FIG. 2, this prior art QHA has core material 5, shorted arms region 6, helical windings 7, two of the windings 7 having a thinner width line section, or indentation 9, and a perpendicular balun board 8. As taught by the Chung et al. '517 application, the indentation 9 must be formed only in one of the pairs of helical arms, and is structured to establish a phasing between the arms to create circular polarization. The indentation 9 inherently decreases conductor radiation resistance, even if formed at a minimum current location as taught by the Chung et al. '517 application, and therefore decreases the antenna efficiency.

Prior Art FIG. 3 shows still another prior art QHA arrangement, disclosed as prior art in U.S. Pat. No. 6,535,179, issued Apr. 18, 2003 to A. Petros ("the Petros '179 patent") having folded arms, arranged and structured as illustrated by the helical arm portions 10, 12, 13 and 14 and their respective parallel folded sections 16, 17, 18 and 19, as labeled by the prior art FIG. 3 of this disclosure. The end of each helical arm portion 10, 12, 13 and 14 opposite its respective parallel folded section (16, 17, 18 and 19) is coupled to a hybrid phase shifter such the related art example illustrated by FIG. 4. The length of the FIG. 3 prior art folded arms, however, is well known to persons skilled in the art as being $3\lambda/4$. See Petros and S. Licul, "'Folded' quadrifilar helix antenna," in *Antennas & Propagation Society International Symposium Digest*, vol. 4, (Boston, Mass.), IEEE, vol. 4, pp. 569-572, July 2001.) Further, although the known practical limit to which the prior art FIG. 3 arms can be folded is $0.5\lambda$, it is also well known that if the length of the folded element (items 16, 17, 18 and 19) is greater than approximately than $0.18\lambda$ the interaction between the arms increases such that a practical and acceptable tuning of the antenna is not likely feasible in the known QHA arts.

Prior art QHA, including the examples illustrated in FIGS. 1-3, are typically connected to a feed circuit providing a different phase shift for each helical element. The phase shifts are often 0, −90, −180 and −270 degrees, for circularly polarized radiation. The circular polarization being left handed or right-handed is determined by the sense of the helical windings (e.g., counterclockwise for right-hand sensed circular polarization and clockwise for left-hand sensed circular polarization) and the phase order of the feed excitations.

Prior Art FIG. 4 shows an example prior art QHA quadrature phase feeding network having an input port, labeled 105, and four phase shift output ports, labeled 110-113. The FIG. 4 exemplary prior art feeding network is formed of three 90-degree hybrid couplers, labeled, 106, 108 and 109, and one minus 90-degree shift line to provide a minus 180 degree phase shift between the input 105 of the hybrid coupler 106 and the input (not labeled) of the hybrid coupler 108.

With continuing reference to prior art FIG. 4, one fundamental aspect of the prior art feeding networks represented by the Figure is that the isolated port of the hybrid coupler 108 is resistively terminated through the element labeled 114 to ground and, likewise, the isolated port of the hybrid coupler 109 is resistively terminated, through the element labeled 115, to ground. Stated differently, prior art QHA feeding networks do not have a differential termination between the hybrid couplers 108 and 109.

Prior Art FIG. 5 shows a block diagram of a second example prior art quadrifilar feeding network, labeled 117, consisting of four separately configured matching networks, labeled 118*a-d*, two 90-degree hybrid couplers, and one 180-degree coupler. The feeding network 117 typically uses stripline or microstrip or a combination of the two in a distributed series formation. One problem with this arrangement is that the characteristic impedance of the series distribution changes for each phased output and, therefore, each of the four antenna matching networks 118*a*, 118*b*, 118*c*, and 118*d* must be differently configured.

Referring again to FIG. 5, one fundamental aspect of such prior art feeding networks is the isolated port of the 90-degree hybrid coupler outputting the 0 and −90-degree feeds is resistively terminated, through element 119, to ground. Likewise, the isolated port of the 90-degree hybrid coupler outputting the −180 and −270 degree feeds is resistively terminated, through element 120, to ground. Stated differently, in the FIG. 5 feed mechanism, and in all similar and related prior art feed mechanisms known to the present inventors, there is no differential termination between the different antenna elements fed example 90-degree hybrid couplers.

All of the FIG. 1-5 other prior art QHA have fundamental limitations, though, that will likely pose significant problems as demand for smaller size, higher performance antennas increases. One problem is bandwidth. The bandwidth of prior art QHA is typically narrow, for example 0.25% using a high dielectric constant of, for example, 39 as a representative number. Another problem is size. Prior art QHA, when first introduced, provided size reduction over certain other antenna types, but further reduction in QHA size appears elusive. Incremental improvements have been made, basically due to general improvements in materials sciences and manufacturing methods.

Dielectric loading has been considered for reducing QHA size. The theoretical basis is that, ideally, in an infinite medium the effective wavelength is reduced by a factor inversely proportional to the square root of the relative dielectric constant. Therefore, theoretically, a relative dielectric constant of 25 yields a calculated size reduction factor of five, which is significant. There are fundamental problems, however, with this method. One is that only the core of the antenna can be dielectrically loaded. Otherwise the structure implementing the loading itself increases overall antenna size. Therefore, the size reduction actually attainable with dielectric loading in prior art QHA is much less than the theoretical reduction factor. Cost is also increased. In addition, loss is increased, reducing efficiency and gain. Further, in the prior art QHA the higher the dielectric constant, the higher the Q, and the bandwidth is therefore reduced.

For these and other reasons, a QHA is needed that provides further size reductions, substantial increase in performance, and improved manufacturability.

SUMMARY OF THE INVENTION

The present invention provides significantly improved quadrifilar antennas having, among other benefits, significant reduction in axial length, and significant improvement in beam pattern, particularly pattern symmetry, bandwidth, front-to-back ratio, polarization purity and impedance control over prior art QHA. Further, quadrifilar antennas according to the present invention provide lower frequency selectivity than prior art QHA antennas, which reduces susceptibility to detuning from proximity to human and objects.

Other improvements that should be mentioned are greater pattern symmetry and polarization purity due to the perfectly symmetrical antenna structure and feeding mechanism.

The present invention provides these and other benefits with embodiments having a combination of helical conducting elements on a dielectric core, further combined with certain and particular structures of open circuit termination conductors connecting to the termination ends of the helical conducting elements The present invention further provides these and other benefits with embodiments having QHA structures combined with a novel phase shift feeding mechanism having a differential termination between different directional transmission paths carrying signals received at, or reflected from different antenna elements. QHA according to these embodiments provide, among other significant benefits, clearly improved polarization selectivity compared prior art QHA. Embodiments may include, as one aspect, a frequency filter as the differential termination element.

The present invention further provides, according to certain embodiments and aspects, a quadrifilar antenna having built-in filtering. The built-in filter is provided by the narrowband antenna match provided by the invention's structures and arrangements of helical conducting elements with particular open circuit terminations. Because of the narrowband antenna match provided by these embodiments and aspects, efficiency of the invention's antenna may be arranged to be maximum at the desired center frequency and minimum for out-of-band signals. This selective setting of antenna efficiency with respect to frequency has substantial benefit in, for example, receiver applications by allowing the designer to remove the bandpass filter before the LNA/receiver, thereby increasing receiver gain, sensitivity, and signal-to-noise ratio (SNR) over what is attainable with prior art QHA.

The present invention further provides, through certain aspects and embodiments of the phase shift feeding mechanisms with differential termination, antenna system radiation, impedance, and reflection characteristics not provided by or not feasible with prior art phase shift feeding mechanisms.

Based on this disclosure, a person of ordinary skill will readily identify various applications for antenna and antenna systems embodying the invention one or more of its aspects. Illustrative examples include satellite position location reception such as GPS terminals. These include, in particular, handheld GPS terminals, as these would especially benefit from the invention's improved reception performance and reduced size. These applications are only illustrative examples, as a wide range and variety of other applications are contemplated including, without limitation, transmission and reception within various mobile terminal (e.g., satellite based) communication systems.

BRIEF DESCRIPTION OF THE DRAWINGS

FIG. 11 illustrates one example layout for implementing an example of one embodiment of one differential termination phase shift feeding mechanism of the invention;

FIGS. 12A through 12C show one example graphical representation, in a Smith chart form, illustrating examples of selecting and varying antenna geometry, phase shifter parasitic and one-stage matching, according to one embodiment of the ISO Port Tuning Method of the present invention;

FIG. 15 illustrates, in block diagram form, one example implementation of a feed section according to a conventional isolated port termination;

DETAILED DESCRIPTION OF ILLUSTRATIVE EMBODIMENTS

The following detailed description refers to accompanying drawings that form part of this description. The drawings, though, show only illustrative examples of embodiments, and of arrangements and implementations for practicing the invention. Many alternative configurations and arrangements can, upon reading this description, be readily identified by persons skilled in the arts.

It will be understood that like numerals appearing in different ones of the accompanying drawings, either of the same or different embodiments of the invention, reference functional blocks or structures that are, or may be, identical or substantially identical between the different drawings.

It will be understood that, unless otherwise stated or clear from the description, the accompanying drawings are not necessarily drawn to scale.

It will be understood that particular examples are described and depicted, illustrating examples embodying one or more of the appended claims. It will be further understood, though, that even if different illustrative examples show different structures or arrangements, they are not necessarily mutually exclusive. For example, a feature described in one disclosed example may, within the scope of the appended claims, be included in or used with other embodiments. Therefore, instances of the phrase "in one embodiment" do not necessarily refer to the same embodiment.

Unless otherwise stated or clear from their context in the description, various instances of terms describing spatial relation of structure(s), such as "over", "around", "above", "adjacent", "arranged on" and "provided on", mean only the spatial relation of the structures referenced and, unless otherwise stated or made clear from the context, do not limit any sequence, type, or order of manufacturing or fabrication.

Embodiments of the invention include a QHA structure and arrangement having four helical arms with certain particularly structured and arranged open circuit terminations. As will be understood, antennas and antenna systems having these embodiments provide improved performance and, because of being open-circuit, provide as well as accompanying substantial reduction in height compared to prior art QHA.

One embodiment of the invention includes a QHA structure and arrangement having four helical arms, each having an open circuit termination according to a particular L-shaped structure and arrangement.

Figure 1:
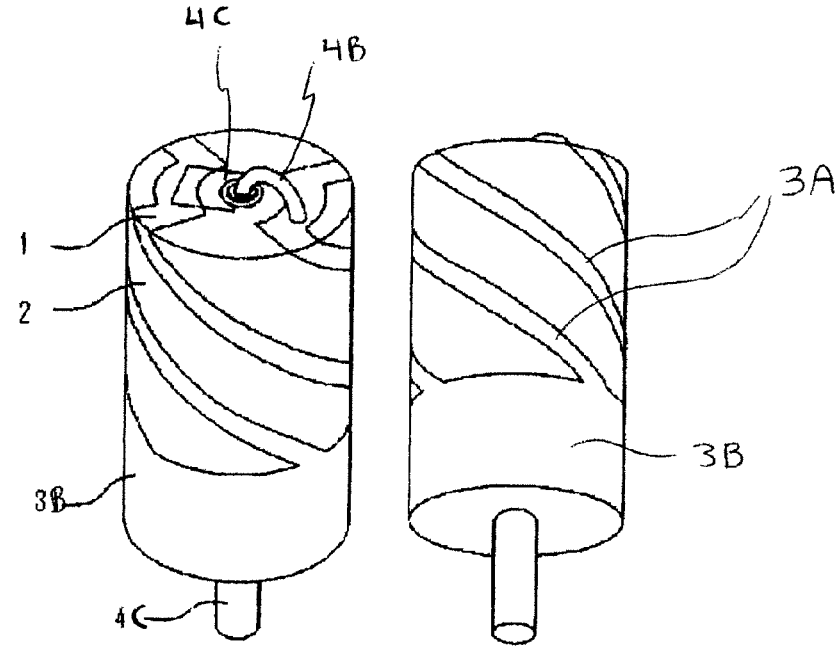
FIGURE 1 PRIOR ART
FIG. 1 is a perspective view illustrating an example prior art QHA with an example prior art integrated balun structure.

As will be described in greater detail below, QHA systems having the L-shaped open circuit termination according to the invention have $\lambda/4$ elements, instead of the $\lambda/2$ elements of prior art QHA as shown in FIG. 1. Therefore, if the same dielectric core is used as in the prior art, a significant height reduction is obtained—in addition to further benefits of significantly improved beamwidth and axial ratio. In addition, as will be understood, if height reduction is not a primary objective, the $\lambda/4$ element length can be further exploited by using a core dielectric $\in_r$ of approximately one-half that of the prior art. On example core dielectric $\in_r$ is approximately 20, compared to a prior art $\in_r$ of approximately 39. In combination with the L-shaped open circuit termination structure of the invention, the lower dielectric antenna core provides significantly improved bandwidth over the prior art, in addition to significantly improved beamwidth and axial ratio.

Figure 3:
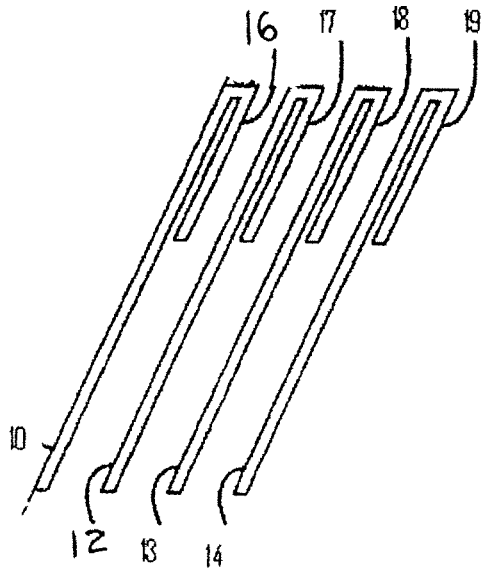
PRIOR ART FIGURE 3
FIG. 3 illustrates a conductor pattern of example of prior art helical conductor arms having prior art folded open circuit terminations.
Figure 4:
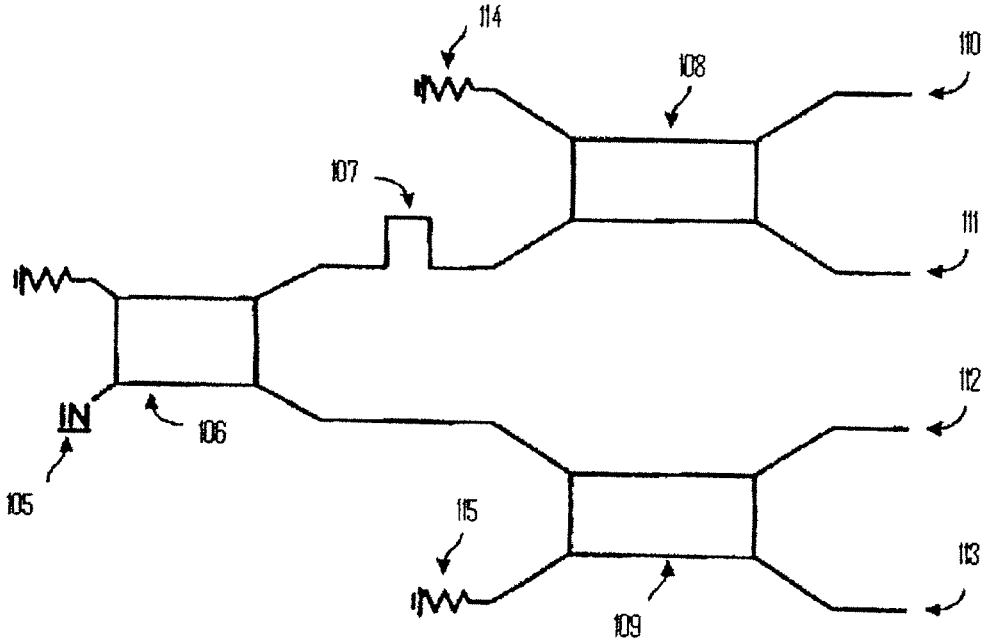
FIGURE 4 PRIOR ART
FIG. 4 is a schematic diagram of one example prior art phase shift antenna feed network circuit.
Figure 5:
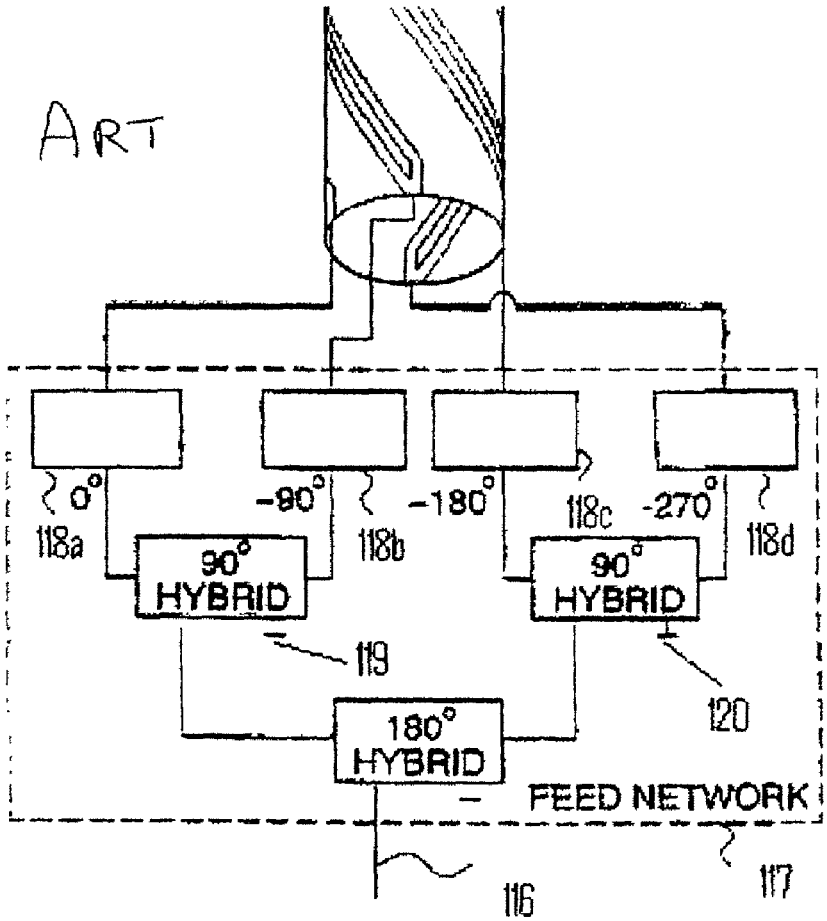
FIG. 5 illustrates as a block diagram another example prior art phase shift antenna feed network circuit.

The L-shaped open circuit termination structure of the invention, used with a conventional phase shift feed mechanism, such as shown in FIG. 5, provides significant reduction in the interaction between conductors, compared to the prior art FIG. 3 folded-arm terminations.

Further embodiments of the L-shaped open circuit termination include combinations with one or disclosed embodiments of a phase shift feed mechanism of the present, later described in greater detail, having a differential termination of return paths from the helical antenna elements. As described in greater detail, the differential termination results in a current flow dominated by antenna elements, instead of phase shifter elements as in conventional feed arrangement, provides better control of impedance rotation, and less susceptibility to interaction with, for example, a human hand or a device to which the antenna is attached.

According to one aspect, structure of the L-shaped, open circuit termination embodiments includes four independently fed helical conductor arms terminating at transverse conductors forming open circuit terminations. The helical conductor arms have a right or left winding direction about a winding cylinder centered on a winding axis. The helical conductor arms are the primary radiating elements and, accordingly, will be referenced as the "helical radiating arms." The transverse conductors form open circuit terminations and are referenced as the "the transverse open circuit terminations." The "transverse" direction means, unless otherwise stated or made clear from its context, extending along an arc about the winding axis, i.e., an arc along a circle about winding cylinder.

According to one aspect, the helical radiating arms may have equal length and, in such a case, a reference plane may be constructed passing through the second distal end of all of the helical radiating arms and extending normal to the winding axis. Preferably, but not necessarily, all of the L-shaped conductor lengths are equal.

According to one aspect of the L-shaped, open circuit termination embodiments, the juncture of the terminating end of each helical radiating arm and its corresponding transverse open circuit termination, viewed from a projection normal to the longitudinal axis, forms an acute angled L-shape, having a specific included acute angle, referenced herein by the arbitrary label "β." The value of the angle β is determined by the helix angle of the helical radiating arm. The structure formed by the terminating end of each helical radiating arms and its transverse open circuit termination is referenced, collectively, as the "L-shaped open circuit termination."

All four transverse termination elements may extend the same length from the distal terminating end of their respective helical arms.

The helical radiating arms and the transverse open circuit terminations may be supported, at least in part, by a cylindrical dielectric core, and an outer cylindrical surface of the core may be the winding cylinder, with the longitudinal axis of the dielectric core also being the winding axis.

The input ports of the helical radiating elements may be, but are not necessarily, at their distal ends opposite the L-shaped, open circuit terminations.

According to one aspect, the feed mechanism may include an input/output port and four isolated output/input ports, constructed and arranged such that, in response to a feed signal input to the input/output port, the four isolated output/input ports respectively output four different phase shifts of the feed signal, each feeding a corresponding one of the helical radiating arms. The four phase shifts may be, but are not necessarily, 0 degrees, −90 degrees, −180 degrees and −270 degrees.

According to one aspect, the helical arms, L-shaped, open circuit terminations, and feed mechanism are constructed and arranged wherein, in response to the phase shifted feed signals of 0 degrees, −90 degrees, −180 degrees and −270 degrees, the helical arms generate a circularly polarized radiation having a given beam pattern and a given frequency spectrum.

According to one aspect, the feed mechanism outputting four phase shifted feed signals of 0 degrees, −90 degrees, −180 degrees and −270 degrees, may be according to a conventional structure, construction and arrangement.

One embodiment of the invention further includes a QHA structure and arrangement having helical arms with L-shaped, open circuit terminations, combined with a phase shifted feed having a novel differential termination arranged between different directional transmission paths receiving signal radiation, or reflections, from different helical arms (i.e., different antenna elements). QHA according to these embodiments provide, among other significant benefits, clearly improved polarization selectivity compared to prior art QHA.

According to one example embodiment of the phase shifted feed having differential termination, the feed structure includes a feed input and four substantially separate and isolated directional transmission paths from the feed input to four corresponding phase shift output ports, each of these paths shifting by a different phase shift an external feed signal received at the feed input. The four different phase shifts may, for example, be 0 degrees, −90 degrees, −180 degrees and −270 degrees. The four phase shift output ports may be connected, respectively, to four helical radiating windings with L-shaped, open circuit terminations.

One example embodiment further includes a first reverse directional path from the 0-degree phase shift output port to a first isolation port and a second reverse directional path from the −90-degree phase shift output port to the first isolation port, where the second reverse path directional path includes a phase shift of −90 degrees relative to the first reverse directional path. This one example phase shifted feed having differential termination includes a third reverse directional path from the −180 degree phase shift output port to a second isolation port and includes a fourth reverse directional path from the −270 degree phase shift output port to the same second isolation port, where the fourth reverse path directional path includes a phase shift of −90 degrees relative to the third reverse directional path.

Further according to this one example phase shifted feed having differential termination, the differential termination is connected between the first isolation port and the second isolation port. The differential termination preferably includes a floating, i.e., ungrounded, transmission path between the first isolation port and the second isolation port. According to various aspects and embodiments, the transmission path of the differential termination between the first isolation port and the second isolation port may be substantially purely resistive, or may be an RLC or equivalent non-reflective frequency selective filter.

According to one example QHA embodiment with a differential termination connecting antenna elements, the four phase shift output ports feed a respective four helical radiating windings, each having an L-shaped, open circuit termination. According to the example, the QHA radiates a circular polarization signal. Further, reflected signals from a first and second of the helical elements return, respectively, through the first and second reverse transmission paths, and form a first reflection sum signal on the first isolation port. Similarly, reflected signals from a third and fourth of the helical elements return, respectively, through the third and fourth reverse transmission paths, and form a second reflection sum signal on the second isolation port. According to the embodiment, the differential termination connects between the first isolation port (having the first reflection sum signal formed by reflection for the first and second helical windings) and the second isolation port (having the second reflection sum signal formed by reflection for the third and fourth helical windings).

As will be understood from reading this entire disclosure, the comparative magnitude and phase difference between the first and second reflection sum signals provides sufficient information to measure the tuning of the actually constructed antenna. Therefore, production QHA systems having example embodiments of the described differential termination phase shift feed provide accurate, practical measuring of the reflections from their helical windings and, therefore, the antenna tuning while operating.

Further, according to one example embodiment with the described differential termination, the phase shift output ports may be connected, respectively, to four helical windings with L-shaped, open circuit terminations, and the first and second reverse directional transmission paths may be arranged such that a given stray signal, not having a given circular polarization, impinging on the first and second helical windings travels, respectively, through the first and second reverse directional transmission paths and appears as a first sum stray signal on the first isolation port, while the given stray signal impinging on the third and fourth helical windings travels, respectively, through the third and fourth reverse directional transmission paths and appears as a second sum stray signal on the first isolation port. According to one aspect, the differential termination connecting the first isolation port to the second isolation may cancel a common mode signal component of the first and second sum stray signals.

Various structures and arrangements and further alternatives having embodiments of the present invention's phase shifted feed with differential termination will be apparent to persons of ordinary skill in the art upon reading the present disclosure.

It will be understood that, unless otherwise stated or made clear from the context, all transmission elements, including described baluns, 90-degree hybrid couplers and 180-degree hybrid couplers, or equivalents, may be implemented as symmetrical elements which, as known in the art, means that any port may be an input port and any port may be an output port. Therefore, it will be understood that unless otherwise stated or made clear from the context, all descriptions referencing ports of elements (e.g., baluns and hybrid couplers) as "inputs" or "outputs" are using these labels only to describe a particular, or predominant function the port performs in the described arrangement.

Another embodiment of the invention includes a QHA structure and arrangement having, for example, four helical conductor arms with double U-shaped, open circuit terminations. Preferably, the helical conductor arms disposed, in a winding arrangement, on a cylindrical dielectric core having low dielectric constant such as, for example, approximately 2.0.

Because of the length of the double U-shaped, open circuit termination conductor, even with a low dielectric constant core (e.g. dielectric constant equal approximately 2.0) a QHA having this arrangement may achieve the same effective axial length (i.e., the QHA height if oriented with its winding axis vertical), in terms of wavelength, as a conventional QHA having a core with a dielectric constant as high as, for example, 36.0. One result, therefore, of this double U-shaped open circuit termination conductor embodiment, further indicated by computer analyses and modeling performed by the present inventors, is a very significant height reduction over prior art QHA—using a low dielectric core—and, therefore, without the known detrimental effects of a high dielectric material core. As one illustrative example, based on computer analyses and modeling performed by the present inventors, a QHA according to this embodiment, having a core with a dielectric constant as low as, for example, approximately 2.0, is contemplated as providing a height reduction, for example, of approximately 70 percent.

Further, another contemplated ultimate benefit, based on computer analyses and modeling performed by the present inventors, and assuming a core dielectric constant of, for example, approximately 2.0, is a very substantial increase in bandwidth over that attainable with the closest comparable prior art QHA. For example, based on computer analyses and modeling performed by the present inventors, assuming a core with a dielectric constant of, for example, approximately 2.0, an approximately 22 times increase in bandwidth is contemplated.

Further, for certain (e.g. very narrowband) applications, antenna systems having embodiments of this double-U shaped open circuit termination may include a dielectric core having a very high dielectric constant such as, for example approximately 36 of higher.

The present inventors have identified, based on the inventors' discoveries and relating computer analyses, that with respect to certain contemplated kinds of applications, a probability exists of antenna systems combining embodiments of the double-U shaped open circuit termination with a prior art phase shift feed exhibiting effects of coupling between conductors such as, for example, helical arms, or different double-U shaped open circuit termination. Specific coupling parameters depend, of course, on the specific geometry and arrangement of the conductors, and other factors.

The present inventors have identified, however, based on and pursuant to the inventors' discoveries, an effective solution for such possible effects pertaining or relating to various potential coupling between conductors. The effective solution is a combination of a QHA structure and arrangement having helical arms with double U-shaped open circuit terminations with a phase shifted feed having an embodiment of the present invention's differential termination, the termination arranged between different directional transmission paths receiving signal radiation, or reflections, from different helical arms (i.e., different antenna elements). The phase shifted feed having differential termination provides cancellation of common mode coupling and, further, provides accurate observations and measurements of fully operational, non-prototype antenna system's radiation, impedance, and reflection characteristics—not provided by or not feasible with prior art phase shift feeding mechanisms. As will be understood by persons of ordinary skill based on reading this entire disclosure, these accurate observations and measurements will permit and enable various tunings of the QHA structure and arrangement having helical arms with double U-shaped open circuit terminations, to reduce the coupling to an acceptable level.

Various structures of the helical conductor arms and the double U-shaped open circuit terminations are contemplated. For example, the helical conductor arms may have a right or left winding direction about a winding cylinder centered on a winding axis.

According to one aspect of the double U-shaped, open circuit termination embodiments, each helical radiating arm extends a length on an outer cylindrical surface of the dielectric core, in a helical extending direction along a helical path extending from a proximal end to a distal end, where "proximal" and "distal" are arbitrary labels. Each helical radiating arm may have a feed port, which may be at the proximal end.

In one example, each double U-shaped, open circuit termination includes a first segment and a second segment, the first segment connecting to the distal end of a corresponding one helical radiating arm, spaced from the helical radiating element by a first given spacing and extending a first segment length from the distal end to a first segment termination. The first segment may extend substantially parallel to the helical radiating element. The second segment of extends a second segment length, from the first segment's termination to an open circuit termination. The second segment is spaced from the first segment by a second given spacing, and may extend substantially parallel to the first segment.

The first and second segment length may be, but are not necessarily, substantially equal. Further, the geometries, arrangements and dimensions of each of the four double U-shaped, open circuit terminations may be, but are not necessarily, equal.

Another embodiment of the invention includes a method, referenced as the "ISO Port Tuning," providing multiple benefits including, but not limited to, direct measurement direct measurement of power levels dissipated at the phase shifter's isolated ports. Since the power dissipated is directly related to the antenna efficiency and impedance mismatch between the antenna and the phase shifter system, the efficiency and impedance mismatch of an actually constructed antenna can be accurately measured with this method, without the measurement introducing unwanted or deleterious effects.

The ISO Port Tuning according to the present invention provides a sequential, iterative design method that quickly, efficiently and directly designs and refines an antenna design and structure such that the actually constructed, operational QHA meets a given performance specification.

According to one aspect, the ISO Port Tuning includes, in sequence, an antenna geometry design optimization, a layout selection and a reactance selection. The antenna geometry design comprises optimizing antenna diameter, height, and pitch angle for optimum impedance Z1. The layout selection according to one aspect includes specifying parameter values of layout parameters such as, for example, antenna pad sizes and phase shifter ground, to achieve an optimum impedance rotation to a desired impedance Z2. The reactance selection comprises constructing a quadrifilar antenna, based on the antenna geometry and layout generated for optimal Z1 and Z2, with a phase shift feed having differential termination, and inserting these into a test arrangement, having an RF signal generator and an RF power/phase measurement instrument. A reactance C (capacitance) and/or L (inductance), with values achieving an optimum impedance rotation to a desired Z3 impedance, is then identified. Identifying the reactance C and L may comprise an intermediated method, where the reflection coefficient is defined as $\Gamma=s_{11}-s_{31}$, where $s_{11}$ is an input reflection coefficient and $s_{31}$ is a coupling coefficient between the quadrifilar antenna arms.

The values of $s_{11}$ and $s_{22}$ are directly measured, as magnitude and phase difference, on the isolated port of the first and second hybrid couplers. According to the differential termination of this invention, this magnitude and phase difference uniquely identifies reflections back from the antenna elements, and the tuning state of the antenna and phase shifter combined. Therefore using the present invention ISO Port Tuning Method one is able to look at both the antenna and phase shifter impedance combined. Based on the measured magnitudes of $s_{11}$ and $s_{22}$ and the measured phase difference between the ISO isolated ports, it is accurately determined whether the antenna is properly tuned.

If the antenna, based on the measured magnitudes of $s_{11}$ and $s_{22}$ and/or the measured phase difference between the two ISO ports, is not properly tuned, a tuning reactance is chosen. The reactance may be chosen by, for example, applying known RF circuit methods for changing the capacitance value and parasitic impedance of the phase shifter, and/or by, for example, changing the length of the antenna arm to vary the inductance L.

The phase shift feed may be incorporated into the antenna, or may be a separate structure. The differential termination of the present invention provides for constructing the antenna and feed structurally substantially identical to, the final product's antenna and phase shift feed with differential termination. This provides much higher certainty than available in the prior art that the final product is optimally tuned and will perform as tested.

The QHA designed, constructed and tuned according to the ISO Port Method of the present invention may have L-shaped open circuit termination arrangement, other disclosed open circuit termination structures, or may combine differential termination feed embodiments of the invention with prior art QHA structures.

Specific Examples According to the Embodiments

Figure 6:
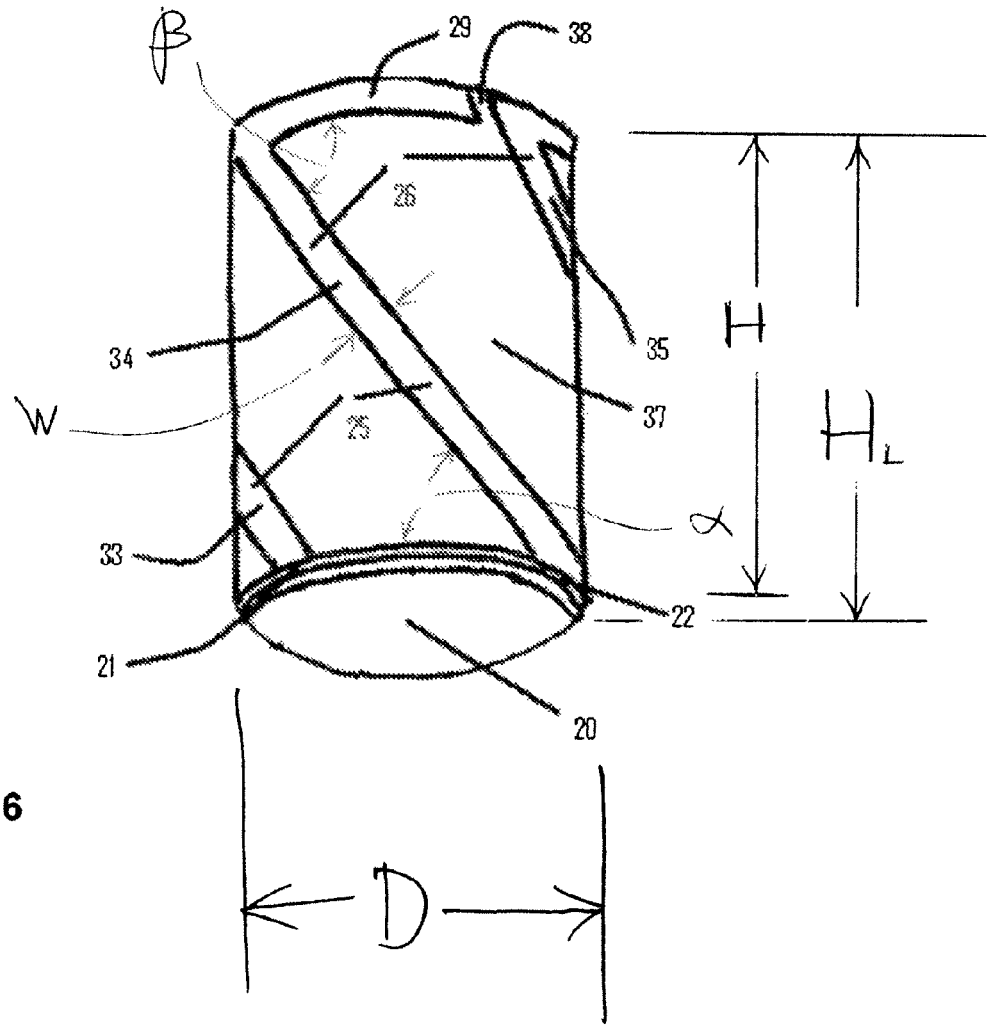
FIG. 6 is a perspective view, illustrating and describing structure of one example according to one embodiment of the invention, including a quadrifilar antenna having helical radiating arms terminated by L-shaped open circuit terminations.

FIG. 6 shows a perspective view of one example quadrifilar antenna according to one embodiment, having four helical conducting arms, of which three, namely 33, 34 and 35 are visible from the FIG. 6 perspective. The fourth arm, 36, is obstructed from view in FIG. 6, but is visible in the FIG. 7 planar view of the FIG. 6 conductors shown.

Referring again to FIG. 6, each of the four helical arms 33-36 is terminated in an acute L-shaped fashion by an open circuit conductor connected to the termination end of the arm and extending substantially transversely. In reference to this example, the phrase "L-shaped open circuit termination" means the termination structure formed by the distal end of the helical conducting arms and the transverse conductor. One of these four L-shaped open circuit terminations, labeled 29, terminates the helical radiating arm 34 and is visible from the FIG. 6 perspective. Each of the three L-shaped open circuit terminations (not visible in FIG. 6) is connected one of the helical radiating arms 33, 35 and 36 and arranged in the same manner as the L-shaped open circuit termination 29. As shown, the L-shaped open circuit terminations of each helical radiating arms is structured and arranged to not touch the adjacent helical radiating arm or L-shaped open circuit termination.

Referring to FIG. 6, the helical arms 33-36, and the L-shaped open circuit terminations, may be printed or otherwise formed on a ceramic or other dielectric core shaped such as, for example, the depicted core 37.

With continuing reference to FIG. 6, embodiments include the four helical conducting arms being equally or symmetrically spaced, as shown in the FIG. 6 example, such that distances 25 and 26 are equal or substantially equal (and are equal or substantially equal to the spacing between the helical arms 35 and 36 and between the helical arms 36 and 33, which are not visible in FIG. 6. This contrasts with the prior art FIG. 1, in which the helical arms are unequally spaced.

Referring to FIG. 6, the core 37 may be any dielectric or ceramic material with a relative dielectric constant between, for example, approximately 2.1 and approximately 40. As readily understood by persons of ordinary skill in the art upon reading this disclosure, the helix angle is dependent on the antenna length H and the diameter D, which is determined by the wavelength. For example, if an antenna according to L-shaped open circuit termination, or other disclosed embodiments, is used for GPS L1-band at 1575 MHz with a core 37 of relative dielectric constant 20, an example antenna diameter is approximately 0.05λ where λ is a wavelength in free space.

With continuing reference to FIG. 6, the length of each of the helical arms and the L-shaped open circuit terminations is preferably as follows: the summed element length of each helical radiating arm and its L-shaped open circuit termination is approximately λ/4 based on a free space core 37. Therefore, at frequency of, for example, 1575 MHz, and assuming a core 37 with a relative dielectric constant of, for example, 20, an example length each helical radiating arm and its L-shaped open circuit termination is approximately 0.1717λ.

Referring to FIG. 6, one example value for the angle β between the element 33 and the transverse segment 29 is approximately 48 degrees. The trace width W may be in accordance with conventional QHA design practice. On illustrative example trace width W is approximately 0.008λ. The height H of the core 37 may be readily determined by applying the knowledge of conventional QHA design practices to this disclosure, including the L-shaped open circuit termination and the selected dielectric constant for the core, in view of a given center frequency, bandwidth and desired beam pattern. One illustrative height of one example implementing core 37 FIG. 6, having a relative dielectric constant 20, is approximately 0.1λ.

Figure 7:
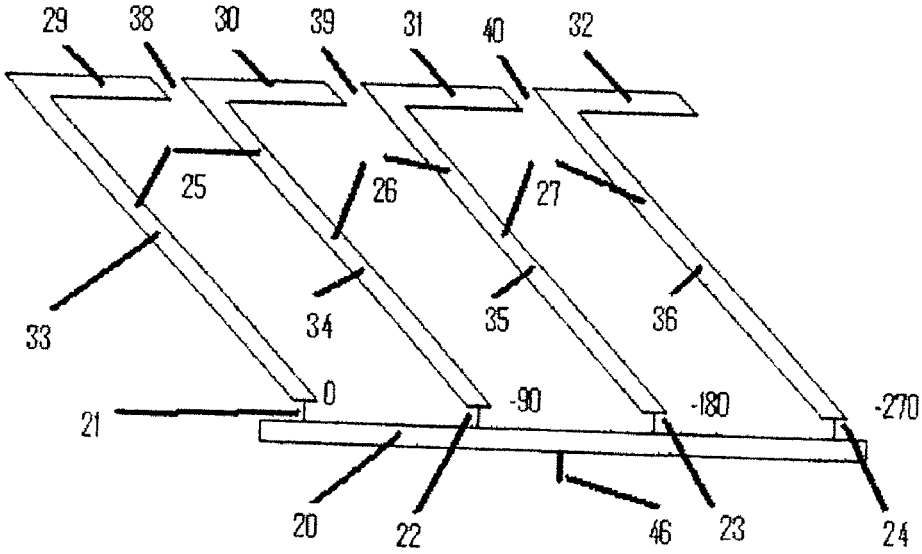
FIG. 7 illustrates and describes one example conductor pattern according to one embodiment having helical radiating arms and L-shaped open circuit terminations, the pattern shown as it would appear unwrapped from the core and flattened onto a plane, also showing example connections to one example feeding mechanism.

FIG. 7 shows one example of a conductor pattern for the L-shaped open circuit termination example illustrated in the FIG. 6 example, shown removed from its supporting core (e.g. core 37) and unwrapped onto a plane. Referring to FIG. 7, pattern shows four helical arms, 33, 34, 35 and 36, each connected via its feed port terminal, labeled 21, 22, 23 and 24, respectively, to a feeding mechanism 20. Each helical arm extends from its feed port and is terminated at its opposite distal end with a transverse segment, forming an L-shaped termination. Each L-shaped termination is therefore formed of a transverse segment, labeled 29, 30, 31 and 32, respectively, connecting to the distal end of the helical arms, 33, 34, 35 and 36.

With continuing reference to FIG. 7, the feeding mechanism 20 is connected to a device (not shown) such as, for example, a handheld device (not shown) through an input 46.

Referring to FIG. 7, in the depicted example the helical arms are separated from one another by equal distances, labeled 25, 26 and 27, respectively. The spacing (not labeled) between helical arms 33 and 36 (which are adjacent when the FIG. 7 view is wrapped) is preferably the same as distances 25, 26 and 27.

With continuing reference to FIG. 7 in the depicted example the transverse segments 29-32 of the L-shaped terminations are preferably substantially transverse to the main helical arms 33-36. Segment 29 is separated by a gap, open-circuit 38, from segment 30. Segment 30 is separated by a gap, open-circuit 39, from segment 31. Segment 31 is separated by a gap, open-circuit 40, with a segment 32. Similarly, segment 32 is separated by a gap (not visible from the FIG. 7 view), open-circuit, from segment 29.

A person of ordinary skill in the art will understand, based on reading this disclosure in its entirety, that the feeding mechanism 20 may be readily arranged to set relative phase between the helical arms 33-36 at 0, −90, −180, and −270 degrees (counterclockwise phase rotation), and the winding sense of antenna helical arms 33-36 is counterclockwise. A person of ordinary skill in the art will also understand, based on reading this disclosure in its entirety, that an antenna according to these embodiments, arranged as such, is right-hand circularly polarized (RHCP).

Figure 10:
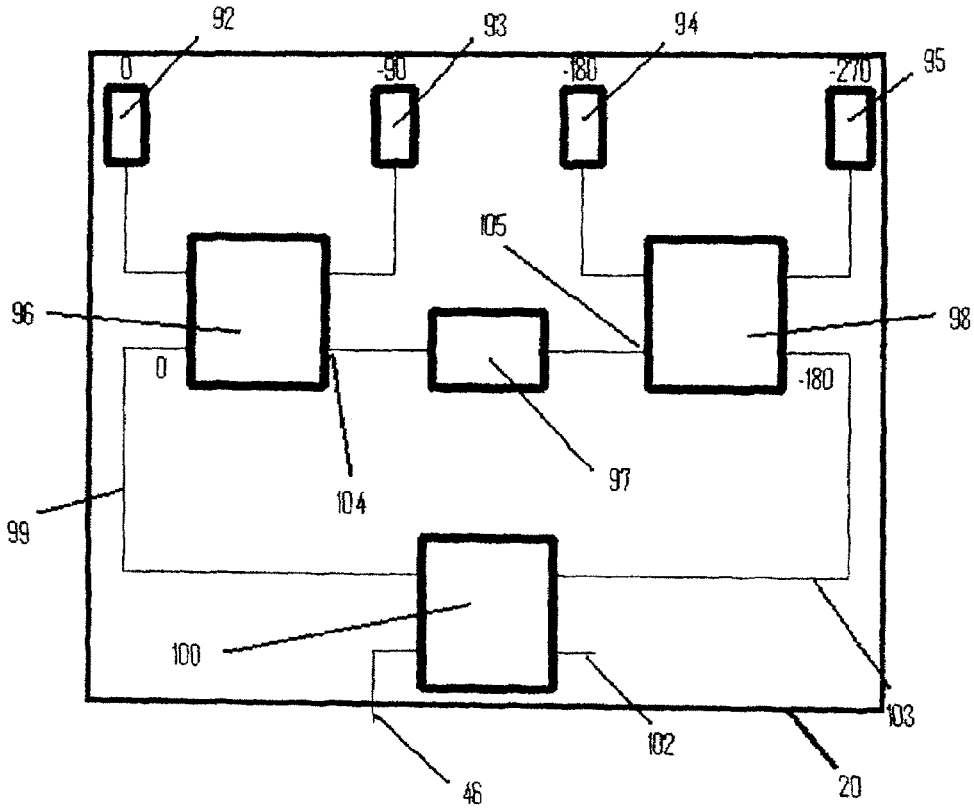
FIG. 10 illustrates, in block diagram form, an example having one embodiment of one differential termination phase shift feeding mechanism embodiment of the invention.

Various implementations of the feed mechanism are contemplated, including a differential termination phase shift feed, which is described in greater detail in reference to FIGS. 10 and 11, and one or more variations based, at least in part, on conventional type of phase shift feed, RHCP arrangements are only examples, not limitations on the scope of embodiments. Embodiments having aspects for readily changing the feeding mechanism 20 such that the phase rotation would be clockwise (e.g. −270, −180, −90, 0 degrees) and the sense of the windings is also reversed and, thus, the antenna will radiate a left-hand circularly polarized wave (LHCP) are described above, in reference to interchanging, with respect to input ports and ISO ports of a first and a second 90-degree hybrid coupler, a balun and a differential termination element. Other examples are described in reference to FIGS. 10 and 11. Further, based on this disclosure, a person of ordinary skill in the art will identify additional obvious means for changing the feeding mechanism 20 such that the phase rotation would be clockwise (e.g. −270, −180, −90, 0 degrees).

The present inventors have identified typical improvements obtainable with QHA according to the L-shaped open circuit termination embodiments, compared to FIG. 1 and similar prior art QHA, using the same high $\in_r$ dielectric core (e.g., $\in_r$=approximately 39) of a 60-67% height reduction, 50% diameter reduction, lower impedance, namely 2-10 ohms as compared to 50 ohms, and shorter element lengths, namely λ/4 instead of 3λ/4). Alternatively, because of the embodiments' λ/4 element length, instead of the 3λ/4 length of prior art QHA, L-shaped open circuit termination embodiments may be constructed with low $\in_r$ cores, (e.g., Ultem™, Lexan™, urethane (with $\in_r$=2 to 3)), having approximately the same helical element height as FIG. 1 and similar prior art QHA, but providing improved bandwidth in addition to all of the above summarized benefits.

Figure 2:
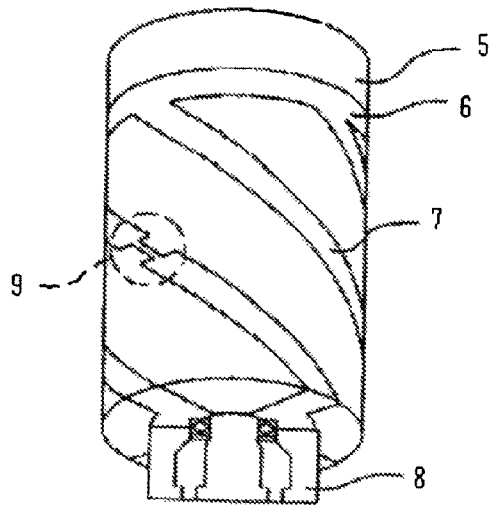
FIG. 2 is a perspective view illustrating an example prior art antenna, having one example prior art perpendicularly mounted PCB board antenna feeding arrangement.
Figure 8:
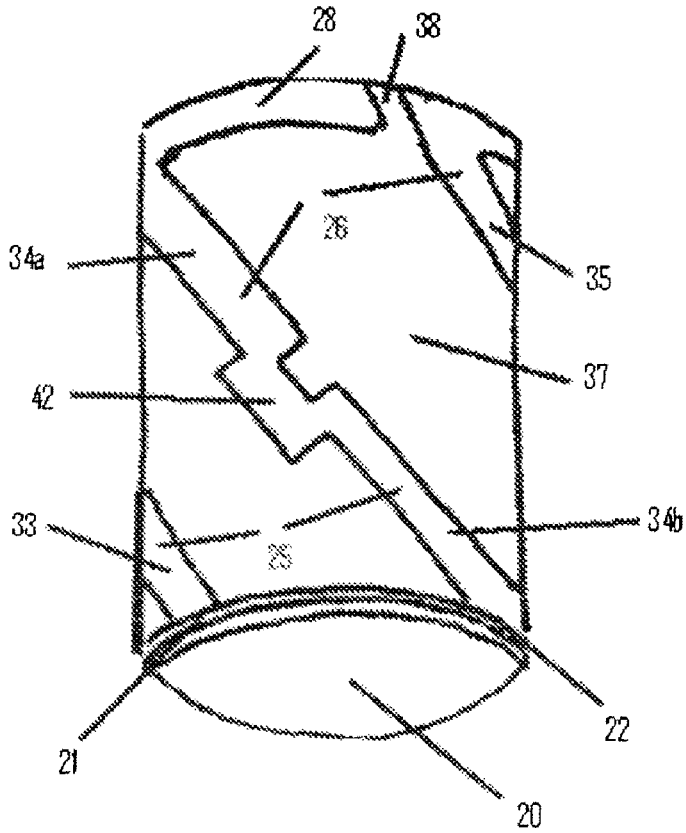
FIG. 8 is a perspective view, illustrating and describing structure of one example according to another embodiment of the invention having a quadrifilar antenna, including a quadrifilar antenna having helical radiating arms including a tooth perturbation, each of the radiating arms terminated by an L-shaped open circuit terminations, and a feeding mechanism.

Referring to FIGS. 6 and 7, the depicted configuration of the example helical arms 33-36 is only one example. FIG. 8 shows, in perspective view, one example alternative L-shaped open circuit termination embodiment, having helical conducting arms such as, for example, the arms 33-36 according to FIG. 6, but with each helical arm formed of sections connected by tooth perturbations, such as the example depicted tooth perturbation 42 between sections 34*a* and 34*b* of helical arm 34. Forming tooth perturbations 42 creates a longer path for currents to flow, to provide some shortening of antenna height with the same effective conductor length. Only one helical arm, namely 34, is visible in FIG. 8 and, therefore, only its tooth perturbation 42 can be seen in that figure. However, it is preferable that the helical arms be symmetric and, therefore that the tooth perturbations, if formed, be identically formed on all four helical arms. The reason is will be understood that the tooth perturbations 42 are not formed to create a circular polarization, which is the function of the narrowed sections 9 shown in the prior art FIG. 2, and taught in the Chung et al. '517 application. Further, unlike the prior art FIG. 2 narrowed sections 9, the location of the tooth perturbations 42 is not dependent on the location of the minimum current on the helical arms.

The illustrated tooth perturbation 42 is only one example quantity and shows only one example geometry. Multiple perturbation teeth (not shown) may be formed. Regarding geometries and dimensions, a person of ordinary skill in the antenna arts, upon reading this disclosure, can readily ascertain specific geometries and dimensions of the tooth perturbations 42 to attain desired height reductions while maintaining desired antenna radiation properties.

Referring to FIG. 8, the tooth perturbations 42 are shown in combination with an L-shaped open circuit termination embodiment, such as described in reference to FIGS. 6 and 7. However, the tooth perturbations may be used to lengthen the conductors of any other open circuit termination embodiment disclosed herein, including the U and double-U shaped terminations described in greater detail below. Further, a person of ordinary skill in the antenna arts, upon reading this disclosure, will understand that the tooth perturbation embodiments may combined with one or more of the differential termination feed embodiments of the invention described in greater detail below.

Figure 9:
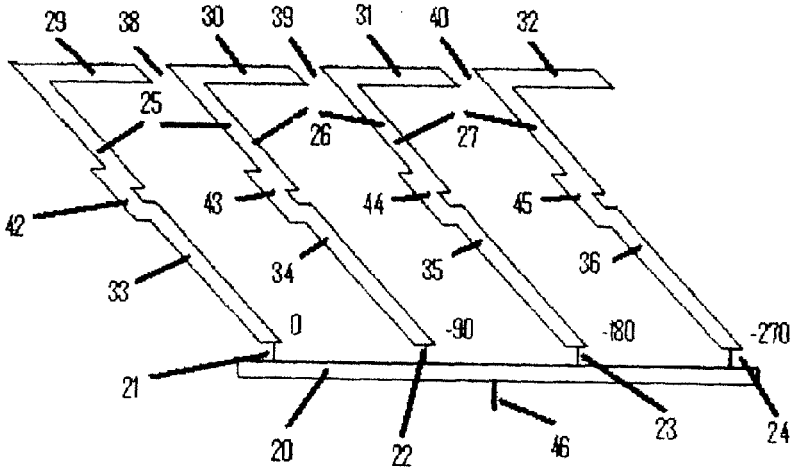
FIG. 9 illustrates and describes one example conductor pattern according to one embodiments having helical radiating arms with tooth perturbations and L-shaped open circuit terminations, the pattern shown as it would appear unwrapped from the core and flattened onto a plane, also showing example connections to one example feeding mechanism.

FIG. 9 shows one example of a conductor pattern for the alternative embodiment shown in the FIG. 8 example, the pattern shown removed from its supporting core (e.g. core 37) and unwrapped into a plane. Referring to FIG. 9, the example conductor pattern includes tooth perturbations 42, 43, 44 and 45. The spacings 25, 26 and 27, as well as the spacing between the helical arms 33 and 36, may be as described in reference to FIGS. 6 and 8.

Referring to FIG. 9, the depicted example shows the relative phase relation between the ports 21-24 as 0, −90, −180 and −270 degrees. As described in reference to the FIGS. 6 and 7 examples of an L-shaped open circuit termination embodiment, the combination of this relative phase, and the depicted helical arm winding direction, generate a right-hand circularly polarized wave. As also described above, changing the arms' winding sense and the arms' phase rotation to clockwise, the antenna radiates a left-hand circularly polarized wave.

The present invention contemplates QHA according to FIGS. 6-9, including QHA having or associated with various phase shift feed mechanisms, including the differential termination aspect of the invention. Illustrative examples are 900 MHz ISM band, 1.575 (L1) and 1.227 (L2) GPS (Galileo, Glonass) bands, 2.3-2.4 GHz satellite radio band, 2.4-2.5 GHz ISM band, 5 GHz ISM band, as well as various cellular, cordless phone, and 2-way radio bands.

Further, as will be understood, by using a relatively high dielectric constant of, for example, 20, significant size reduction is obtained compared to free space, and significant increase in bandwidth is obtained over prior art. Therefore, the antenna may be used also for GPS P-code acquisitions at 1575.45±10 MHz. The enhanced bandwidth allows for minor variations in center frequency during manufacturing which makes for a lower cost design than prior art.

FIG. 10 illustrates, in block diagram form, one example having one embodiment of a differential termination phase shift feeding mechanism of the invention, which may implement the phase shift feed network shown in FIG. 7, outputting four phase shifted feed signals of 0 degrees, −90 degrees, −180 degrees and −270 degrees.

Referring to FIG. 10, the outputs of 0 degrees, −90 degrees, −180 degrees and −270 degrees are output at narrowband matching networks 92, 93, 94 and 95, respectively. Two 90-degree (also known as "quadrature") hybrid couplers 96 and 98, each having one "input" port, a 0 degree shift "output" port, a −90-degree shift (or "quadrature") "output" port and an "ISO" or isolation port. Each of the couplers 96 and 98 may be a symmetric hybrid. A single differential real impedance load 97 connects the ISO port of the hybrid coupler 96 to the ISO port of the hybrid coupler 98. The load 97 is preferably selected to present the proper load impedance to the isolated (ISO) ports 104 and 105 on each of the quadrature hybrid couplers 96 and 98. An illustrative example value is 100 ohms.

Referring to FIG. 10, the 90-degree hybrid couplers 96, 98 may be selected from off-the-shelf commercially available devices to have very low insertion loss (such as, for example, about 0.2 dB), which may be obtained with conventional thin/thick film and coupled/stripline techniques.

With continuing reference to FIG. 10, the balun 100 may be readily implemented using conventional LTCC technology. Further, the balun 100 may be a transformer balun, as these have many wire turns and, therefore, can be used to transform the impedance of the input 46 to values such as, for example, between 25-Ω, 50-Ω, or 100-Ω. The radio receiver (not shown) may then choose to interface with a 25-Ω, 50-Ω, or 100-Ω impedance source/load as required for the particular application. The impedance may be selected as part of a design phase before manufacturing. Further, since baluns are available (or may be constructed) in different transformer ratios they can be easily replaced, by only a part change, to meet different RF front-end impedance requirements. Regarding impedance selection, this may be through application of convention RF design methods known to persons skilled in the relevant arts. For example, some applications using a low noise amplifier (LNA) require lower impedance than the standard 50-Ω reference; to achieve lowest noise figure and/or optimum power gain in the LNA (or maximum output power in power amplifier).

Referring to FIG. 10, for many contemplated applications, a small size would be preferable and, accordingly, a low temperature ceramic (LTCC) process may be used for building many layers into a small package to fit under the base of a low profile quadrifilar antenna according to or more embodiments of the invention. A person of ordinary skill in the art, applying these LTCC technologies, can readily obtain a phase match suitably close to 90 degrees over a broad bandwidth spanning, for example, approximately 1 GHz.

Figure 14:
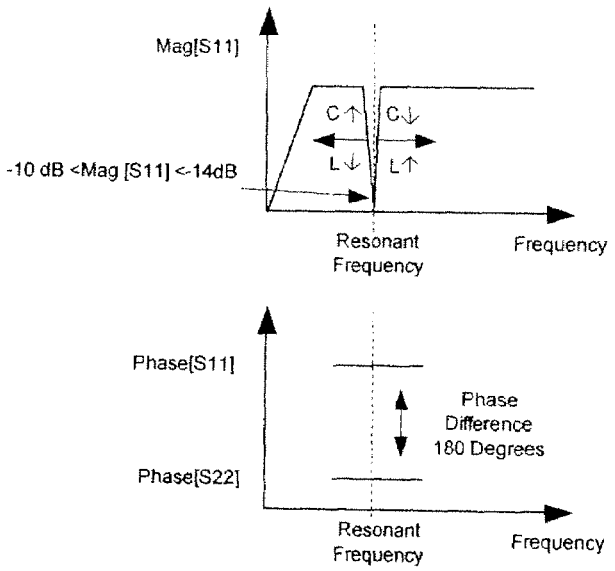

With continuing reference to FIG. 10, it is noted that in the closest prior art arrangements, such as the example shown in FIG. 15, the ISO ports corresponding to 104 and 105 are terminated with grounded single-ended resistors. Referring to FIG. 14, the present invention replaces these ground terminations by a single differential impedance, such as 97, without any connection to ground.

Referring to the FIG. 10 example, a balun 100 receives an unbalanced signal at input 46. The isolation port 102 of the balun may float. The 0-degree phase shift balanced signal output of the balun 100 connects to the input port of the first 90-degree hybrid coupler 96. The −180 degree phase shift balanced signal output of the balun 100 connects to the input port of the second 90-degree hybrid coupler 98. The 0-degree phase shift signal output of the first 90-degree hybrid coupler 96 connects to the narrowband matching network 92. Similarly, the −90-degree phase shift signal output of the first 90-degree hybrid coupler 96 connects to the narrowband matching network 93. In a like manner, the 0-degree phase shift signal output of the second 90-degree hybrid coupler 98 connects to the narrowband matching network 94, and the −90-degree phase shift signal output of the second 90-degree hybrid coupler 98 connects to the narrowband matching network 95. As readily seen, this example arrangement delivers shifted feed signals of 0 degrees, −90 degrees, −180 degrees and −270 degrees to the narrowband matching networks 92 through 95, respectively.

With continuing reference to FIG. 10, the depicted arrangement provides one reflection path from the input (not labeled) of the matching network 94, into the 0-degree output of the first 90-degree hybrid coupler 96, and to the ISO port of that coupler. Another path is provided from the input (not labeled) of the matching network 94, into the 0-degree output of the first 90-degree hybrid coupler 96, and to the input port of that coupler. This path, in the arrangement depicted in FIG. 10, has a −90 degree phase shift. Similarly, two reflection paths back from the matching network 93 are formed; one from the network 93 to the ISO port of the first 90-degree hybrid coupler 96 and another from the network to the input port of the first 90-degree hybrid coupler 96. The path from the network 93 to the ISO port of the first 90-degree hybrid coupler 96 has a −90 degree phase shift.

Referring to FIG. 10, assuming reflections back from the antenna elements have a −90 degree phase shift (which is typical), it is seen that reflections from the matching networks 92 and 93 cancel at the input of the first 90-degree hybrid coupler 96, and sum at the ISO port 104 of the coupler 96.

Further referring to FIG. 10, it is seen that reflections from the matching networks 94 and 95 cancel at the input of the second 90-degree hybrid coupler 98, and sum at the ISO port 105 of the second coupler 98.

Referring to FIG. 10, the balun 100 may be replaced with a balanced filter (not shown) having, for example a balun or equivalent for the unbalanced to balanced coupling, for example, a frequency selective filter (not shown) in the same package. The frequency selective filter may, for example, be customized to add additional filtering characteristics to the antenna for increased SNR/SNIR (reduced out of band signal/emissions) characteristics. This provides even further increase in insertion loss (reduction in receiver sensitivity) for unwanted signals, and reduction in unwanted signal transmit power.

As will be understood by persons skilled in the art upon reading this disclosure, the above example FIG. 10 arrangement is only one illustrative example embodying the phase shift feed with differential termination. Further, the particular phase ordering used in the example ordering is only one illustrative example, not a limitation on the invention.

For example, the phase order of 0 degrees, −90 degrees, −180 degrees and −270 degrees may be readily reversed, to obtain, for example LHCP, if the sense of the windings is also reversed. This interchange may, for example, be performed by interchanging the input balun 100 with the resistive termination 97 connecting the respective ISO ports 104 and 105 of the first and second 90-degree hybrid couplers 96 and 98. Further, this interchange does not require moving the input balun 100 or the 90-degree hybrid couplers 96 and 98. It may be effected by simply removing the resistive termination 97 connecting the ISO ports 104 and 105 the 0-degree balanced feed signal from the balun 100 to the ISO port 104 of the first 90-degree hybrid coupler 106, connecting the −180 degree balanced feed signal from the balun 100 to the ISO 105 port of the second 90-degree hybrid coupler 108, and connecting the resistive termination 97 between the input port of the first 90-degree hybrid coupler and the input port of the second 90-degree hybrid coupler. The result is a phase ordering of −270 degrees, −180 degrees, −90 degrees and 0 degrees.

FIG. 11 illustrates one example layout for implementing a circuit, in accordance with the FIG. 10 example block diagram, having a differential termination phase shift feeding mechanism of the invention. The circuit topology of the FIG. 11 example arranges the hybrid couplers 96 and 98 in separate packages, providing better isolation between signals and, therefore, improved isolation among the four antenna ports. Since the balun 100 converts a differential signal (with 0 and 180 phase difference) into an unbalanced signal referenced to a ground plane, the ground plane must be close to the balun, but does not have to be close to the antenna because the only signals needed are 0 and 180.

Referring to FIG. 11, the 90-degree hybrid couplers 96, 98 and balun 100 may be implemented by, for example, low temperature ceramic technology (LTCC). Balun 100 may, for example, be soldered and interconnected on a dielectric substrate, using FR4 or similar technology, as shown. The arrows in FIG. 11 indicate direction of current flow through a differential resistor 97 topology.

With continuing reference to FIG. 11, in contrast to the teachings of the prior art, the differential resistor 97 is not connected to a ground 128,124. As will be understood, this further provides the significant advantage of reducing the interaction of the grounds 128,124 with antenna ports 92-95 which causes parasitic effects leading to unequal impedances presented to the antenna elements at the ports 92-95.

Therefore, as seen from the FIG. 11 example, the differential topology in accordance present invention allows a designer to remove ground planes 128,124 and to create symmetric impedance at the antenna ports 92-95 for easy antenna tuning. This, in turn, is contemplated by the present inventors as further increasing antenna efficiency and, further, as improving axial ratio. Further, the differential resistor 97, by eliminating the two grounding terminations and allowing removal of the ground planes 128 and 124, also allows part count reduction and reduces manufacturing cost.

FIGS. 12A through 12C depict one example graphical representation, in a Smith chart form, illustrating examples of selecting and varying antenna geometry, phase shifter parasitic and one-stage matching, according to one embodiment of the ISO Port Tuning Method of the present invention.

Figure 13:
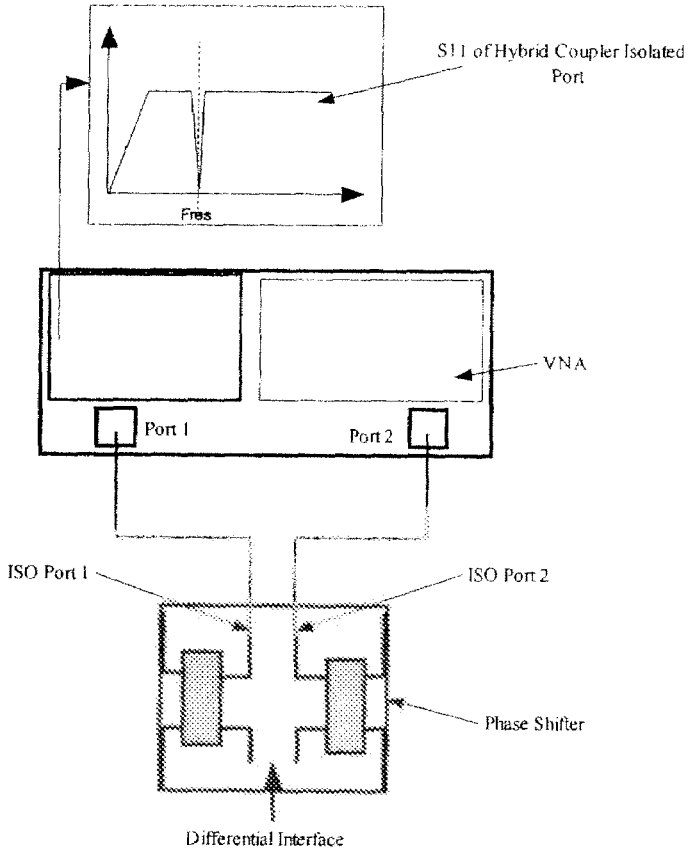
FIG. 13 shows one example ISO port tuning setup for implementing certain aspects in accordance with the FIG. 12 example FIG. 14 graphically illustrates one example model magnitude and phase ISO port response, and one example model effects of capacitance and inductance on antenna resonant frequency, in performing ISO Port Tuning Method for antenna impedance selection and control according to one differential feeding mechanism embodiment of the invention.

FIG. 13 shows one example ISO port tuning setup for implementing certain aspects in accordance with the FIG. 12 example.

FIG. 14 graphically illustrates one example model magnitude and phase ISO port response, and one example model effects of capacitance and inductance on antenna resonant frequency, in performing ISO Port Tuning Method for antenna impedance selection and control according to one differential feeding mechanism embodiment of the invention.

Referring to FIGS. 12A-12C through 14, one example according to the ISO Port Tuning Method of the present invention, for design and construction of an optimally tuned QHA comprises: (i) optimizing the antenna geometry for optimum impedance Z1, as shown in FIG. 12A; (ii) designing the layout of certain circuit structures for optimum impedance rotation to impedance Z2, as shown in FIG. 12B; (iii) constructing a quadrifilar antenna and differential termination phase shift feed, based on the layout; and (iv) testing the constructed antenna to choose a correct capacitance or inductance value(s) to achieve an optimum impedance rotation to the desired Z3 impedance, as shown in FIG. 12C, employing the differential termination feed mechanism of the invention.

Regarding the step of optimizing the antenna geometry for optimum impedance Z1, as shown in FIG. 12A, the geometry is defined by diameter D, height H, and pitch angle $\alpha$.

Regarding the step of designing the layout to achieve an optimum impedance rotation to impedance Z2 as shown in FIG. 12B, one example of layout design parameters to vary is antenna pad size parameters and phase shifter ground parameters.

Regarding the step of constructing a quadrifilar antenna and differential termination phase shift feed, the may be in accordance with the examples illustrated in FIGS. 6 and 7 or, the examples illustrated in FIGS. 8 and 9. Further, the antenna may be in accordance with the double-U open circuit termination embodiment described in greater detail below. The phase shift feed may, for example, be in accordance with the example illustrated at FIGS. 10 and 11. The phase shift feed may be incorporated into the antenna, or may be a separate structure. Preferably, so that the subsequent testing accurately represents the actual constructed antenna, the phase shift feed with differential termination is identical to, or structurally substantially identical to, the phase shift feed having differential termination that will be in the final product.

Regarding the testing for choosing correct C (capacitance) or L (inductance) values, C can be realized using the pads on the phase shifter board that connects to the antenna windings in combination with a matching network (which is typically LTCC capacitor of 0.1-10 pF in value). Different values of L may be realized by adjusting the lengths of the antenna windings. Even broader, complex impedances Z3, as well as Z2, may be realized using the phase shifter PCB board as a combination of antenna pads and ground distribution on the phase shifter PCB board, and fixed capacitance value (LTCC capacitor).

Further regarding testing for choosing an optimum impedance rotation to desired Z3 impedance, as shown in FIG. 12C, one example for the testing and choosing includes what is termed herein an "intermediated method," where the reflection coefficient is defined as $\Gamma=s_{11}-s_{31}$, where $s_{11}$ is an input reflection coefficient and $s_{31}$ is a coupling coefficient between the quadrifilar antenna arms. These coefficient values are determined by injecting a test signal and measuring reflection signals at the isolation ports, such as the ISO ports 104 and 105 of the example differential feed described in reference to FIG. 10, connected by a differential termination such as item 97.

Referring to FIG. 13, one example of the intermediated method of this invention comprises placing the constructed antenna and feed mechanism into a test arrangement, such as the example setup shown in FIG. 13, having an RF signal generator and an RF power/phase measurement instrument, and then checking $s_{11}$ and $s_{22}$ on the isolated port of the hybrid couplers by injecting a test signal and measuring reflection signals at the isolation ports. Example isolation ports are the ISO ports 104 and 105 described in reference to FIG. 10, connected by a differential termination such as item 97 shown in FIG. 10

The reactance(s) chosen may be a C (capacitance) or L (inductance), and will have values to achieve an optimum impedance rotation to a desired Z3 impedance.

The values of $s_{11}$ and $s_{22}$ are directly measured, as magnitude and phase difference, on the isolated port of the first and second hybrid couplers (e.g. ISO ports 104 and 105 described in reference to FIG. 10). As described above and elsewhere in this disclosure, the signals on the isolation ports of the first and second hybrid couplers are respective sums of reflections from the antenna elements when the antenna is fed by the phase shift feed mechanism. The magnitude and phase difference of these reflection signals indicates the tuning state of the antenna and phase shifter combined. Therefore using the ISO port tuning method of this invention, direct measuring of both the antenna and phase shifter impedance, combined, is provided.

If the measured magnitudes of $s_{11}$ and $s_{22}$ are below a given value such as, for example, about minus 14 dB, and the measured phase difference between the ISO isolated ports is 180 degrees, or within a given tolerance of 180 degrees, the antenna is properly tuned.

If the measured magnitudes of $s_{11}$ and $s_{22}$ are not below the given value, such the example minus 14 dB, and/or the measured phase difference between the ISO isolated ports is not 180 degrees, or is not suitably close to 180 degrees, the antenna is not properly tuned.

It will be understood that the minus 14 dB example of a given inspection threshold value of the magnitudes of $s_{11}$ and $s_{22}$ is based on one example contemplated performance specification of a QHA embodying the one or aspects of the invention, but is only one example. Other example inspection threshold values of the magnitudes of $s_{11}$ and $s_{22}$ are, without limitation, minus 10 dB, minus 11 dB, and minus 20 dB.

If the antenna, based on the measured magnitudes of $s_{11}$ and $s_{22}$ and/or the measured phase difference between the two ISO ports, is not properly tuned, a tuning reactance is chosen. The reactance may be chosen by, for example, applying known RF circuit methods for changing the capacitance value and parasitic impedance of the phase shifter, and/or by, for example, changing the length of the antenna arm to vary the inductance L. FIG. 14 shows an example amplitude and phase ISO port response for such a tuning.

It will be understood that the ISO Port Method according to this invention is not limited to a one-time optimizing. For example, the ISO Port Method may used once to obtain an optimal production design and then, because if the testability provided by the phase shift feed with differential termination of the present invention, each QHA, even in high volume manufacturing, may be inspected and verified and, if necessary, fine tuned. Such testability is not possible with prior art QHA phase shift feeds.

Figure 16:
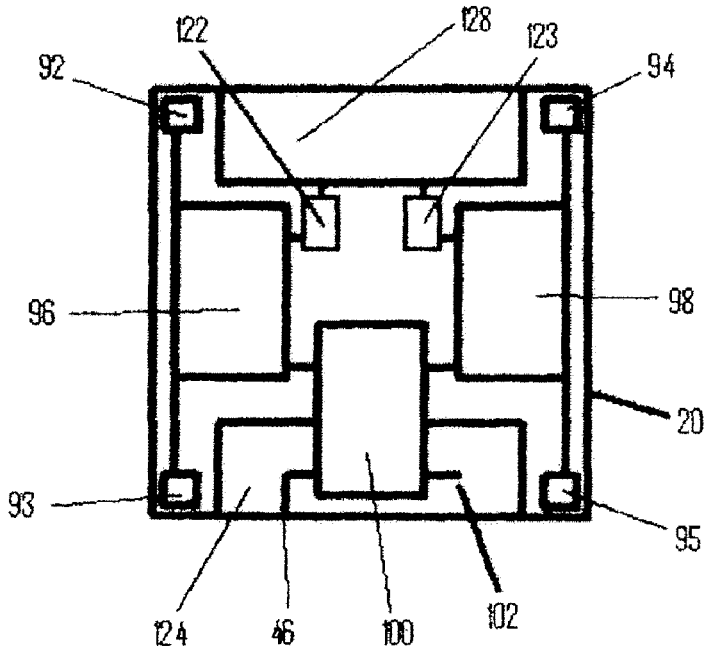
FIG. 16 illustrates one example layout of a feed according to a conventional isolated port termination for implementing a feed section of one embodiment of the invention.

FIG. 15 illustrates, in block diagram form, one example of a phase shift feed according to a conventional isolated port termination that, according to certain embodiments of the invention, may be substituted for the differential termination phase shift feed. The FIG. 15 example is shown as an alteration of the FIG. 10 example of the present invention's differential termination. Referring to FIG. 16, the fundamental difference with respect to FIG. 10 is that, in compliance with prior art practice, the ISO port 104 of the first 90-degree hybrid coupler 96 is terminated through resistive element 122 to the ground pad 140, and the ISO port 105 of the second 90-degree hybrid coupler 98 is terminated through resistive element 123 to the same ground pad 140.

FIG. 16 illustrates one example layout of a phase shift feed according to a conventional isolated port termination such as FIG. 15 which, according to certain embodiments of the invention, may be substituted for the differential termination phase shift feed.

Referring to FIGS. 15 and 16, it will be understood that since ISO ports 104 and 105 are effectively grounded, instead of the present invention's connection of these ports 104 and 105 by a floating differential termination element, the ISO Port Tuning method cannot be properly practiced, and the present invention's cancellation of common mode signals is not provided. However, as will be understood, certain embodiments such as, for example, of the L-shaped open circuit termination, may be practiced.

Figure 17:
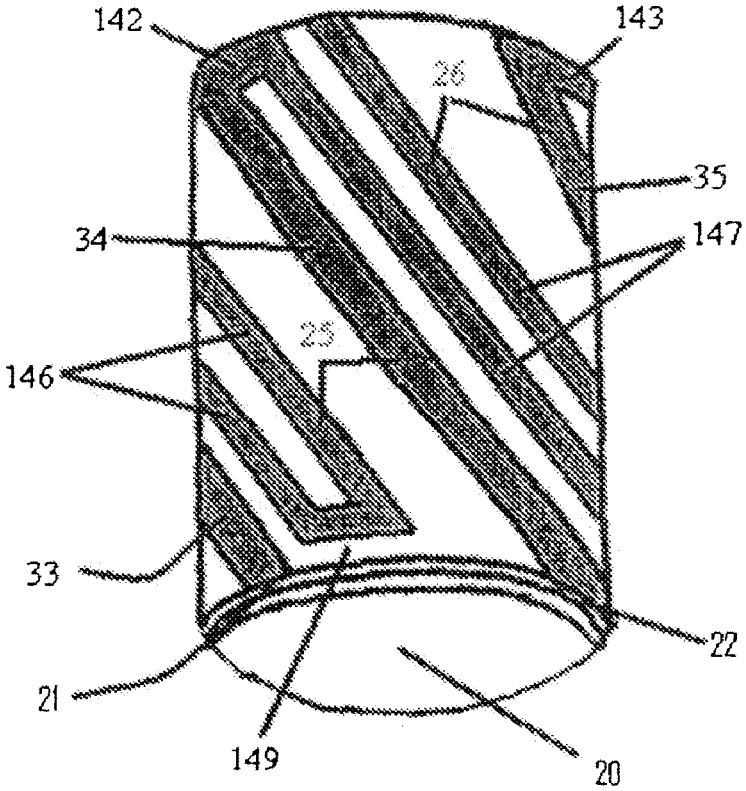
FIG. 17 is a perspective view, illustrating and describing example structure of one example having one embodiment of the invention, including a quadrifilar antenna having helical radiating arms terminated by double-U open circuit terminations.

FIG. 17 is a perspective view, illustrating and describing example structure of one example according to another embodiment of the invention, including a quadrifilar antenna having helical radiating arms terminated by double-U open circuit terminations.

Figure 18:
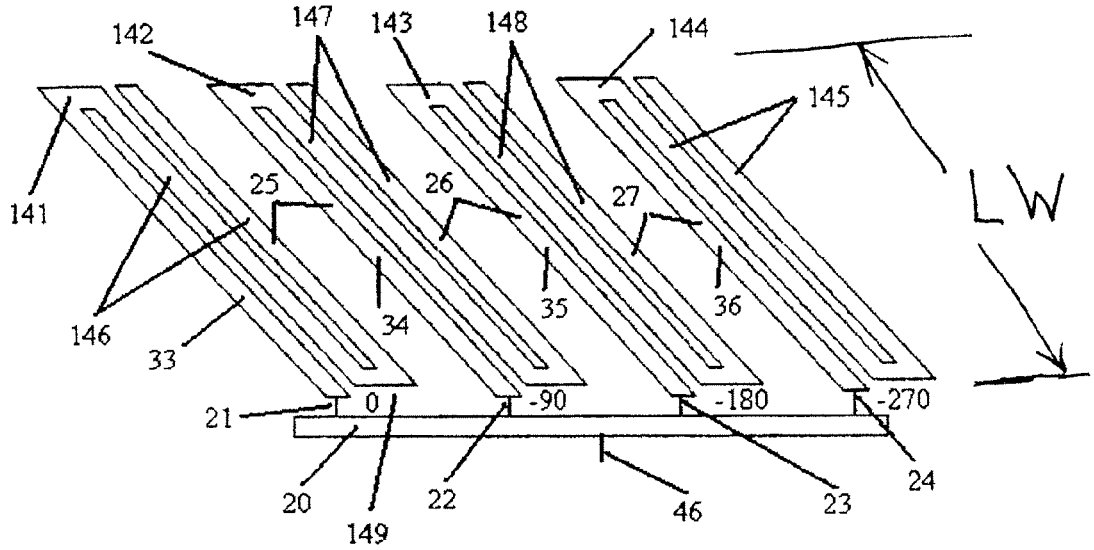
FIG. 18 illustrates and describes one example conductor pattern according to one embodiment having helical radiating arms and double-U shaped open circuit terminations, the pattern shown as it would appear unwrapped from the core and flattened onto a plane, also showing example connections to one example feeding mechanism.

FIG. 18 illustrates and describes one example conductor pattern according to one example double-U shaped open circuit termination embodiment such as, for example, the example depicted in FIG. 17, as it would appear unwrapped from the core and flattened onto a plane.

Referring to FIGS. 17 and 18 concurrently (because the perspective view of FIG. 17 does not permit viewing of all conductors), the example includes four helical radiating arms, 33, 34, 35 and 36, each extending from its connection to a phase shift feed 20 a length LW to a terminal end, the terminal ends labeled 141, 142, 143 and 144, respectively. Connected to each terminal end is double U-shaped, open circuit termination, such as the depicted examples labeled 146, 147, 148 and 149.

Referring to FIGS. 17 and 18, each double U-shaped open circuit termination includes a first segment (not separately labeled) and a second segment (not separately labeled), the first segment connecting to the terminal end of a corresponding one helical radiating arm (i.e. 141, 142, 143 and 144). Each first segment extends a first segment length (not separately labeled) which, in this example, is substantially the same as the length LW of the helical radiating arm from the distal end to a first segment termination (not separately labeled), in a direction substantially opposite the helical extending direction. Since, in this example, the first segment length is substantially the same as the length LW of the helical radiating arm, the first segment termination is generally proximal the feed point of the helical arm.

With continuing reference to FIGS. 17 and 18, in the illustrated examples the feed network connects to each helical radiating arm at a terminal end of the arm that is opposite the end terminated by the double U-shaped open circuit termination. This is only one example connection; similar to feed connection techniques known in the prior art QHA, the helical arms may be fed at other points along their respective lengths.

Referring to FIGS. 17 and 18, in the depicted example the first segment of each double U-shaped open circuit termination extends substantially parallel to the helical radiating element and is spaced from the helical radiating element by a first given spacing (not separately labeled). The second segment (not separately labeled) of each double U-shaped, open circuit termination extends a second segment length (not separately labeled), in a direction substantially the same as the helical extending direction, from the first segment's termination (not separately labeled) to an open circuit termination. The second segment, in this example, extends substantially parallel to the first segment and to the helical radiating arm and is spaced from the first segment by a second given spacing.

Referring to FIGS. 17 and 18, the relative length of the termination the length LW, the first segment length and the second segment length are shown equal, but are not necessarily, substantially equal. Further, first spacing between the helical arms 33, 34, 35 and 36 and the immediately adjacent first segment of the respective double U-shaped open circuit terminations may be, but is not necessarily, equal to the second spacing between the first segment and the second segment.

As described previously in this disclosure, because of the length of the double U-shaped, open circuit termination conductor, even with a low dielectric constant core (e.g. dielectric constant equal approximately 2.0) a QHA having this arrangement may achieve the same effective axial length (i.e., the QHA height if oriented with its winding axis vertical), in terms of wavelength, as a conventional QHA having a core with a dielectric constant as high as, for example, 36.0. Accordingly, QHA having the double U-shaped open circuit termination conductor embodiment are contemplated as providing a very significant length reduction, and bandwidth increase over prior art QHA—using a low dielectric core—and, therefore, without the known detrimental effects of a high dielectric material core.

Further, for certain (e.g. very narrowband) applications, antenna systems having embodiments of this double-U shaped open circuit termination may include a dielectric core having a very high dielectric constant such as, for example approximately 36 of higher.

Preferably, but not necessarily, antenna embodying the double-U shaped open circuit termination such as, for example, the example depicted by FIGS. 17 and 18, are combined with, or integrated with, a feed mechanism according to the present invention's differential termination phase shift feed mechanism.

This combination is contemplated as enabling effective minimization of coupling between conductors, e.g., such as between helical arms 33 and 34, or between helical arm 33 and adjacent double U-shaped open circuit termination elements. Referring to the example differential phase shift feeds depicted in FIGS. 10 and 11, such coupling signals will appear on the ISO ports 104 and 105 of the first and second hybrid couplers 96 and 98, and may be canceled by the differential termination element 97.

Referring to FIGS. 10 and 11, an example polarization selectivity example embodiments will be described having a non-reflective RLC or equivalent frequency selective filter within or integrated with the differential termination, e.g., element 97, between a terminal end of two different reverse or reflection directional paths back from different helical arms, e.g., ISO ports 104 and 105 of the first and second hybrid couplers 106 and 108.

As previously described, since the floating differential termination 97 removing the ground connection used in prior art QHA feed (e.g. resistors 122 and 123 shown in FIG. 15), a common-mode center is formed between the two ISO ports 104 and 105. These signals on the ISO ports 104 and 105 are 180 degrees out of phase, i.e., are differential signals. Any radio signal received by the antenna that is not circularly polarized (such as linearly polarized cellular signals), collectively referenced herein as "stray signals" will produce the same signal on all input ports, i.e., common-mode signals. Further, any stray signals on the ISO ports 104 and 105 that do not cancel across the load impedance 97 will pass into the other ISO port 104 and 105, i.e., the ISO port of the opposite quad hybrid coupler 96, 98, and appear on both sides of the balanced (0 and ±180) ports 99, 103 of the balun 100. The balun 100 will then remove any common-mode signals that are the same on both sides (0 and ±180) and pass only the differential signals extracted from the desired circularly polarized signal, also at the center frequency of the narrowband matching circuit.

It will be understood that quadrifilar antennas having described embodiments provide inherent or "built-in" filtering from the combination of the open-circuit terminations, the narrowband match, and a high dielectric constant ceramic material. The combination of these three factors contributes to "built-in" filter benefits. This built in filter maximizes efficiency at the desired center frequency, and minimizes out-of-band signals. This built in filtering is useful in receiver applications because it allows the designer to remove the bandpass filter before the LNA/receiver, thereby increasing receiver gain, sensitivity, and signal-to-noise ratio (SNR).

One additional embodiment of the invention provides even further frequency selectivity, and improvement in efficiency, by including in the invention's phase shift feed mechanism with differential termination an RLC, or equivalent, non-reflective frequency selective impedance within or connecting the mechanism's reverse directional paths back from the phase shift feed output ports (i.e., the paths carrying signals received at the helical elements of the antenna, or signals reflected back from the helical elements due, for example, to mismatches).

Referring to FIG. 10, one example of this additional embodiment may be implemented by replacing the differential resistor 97 connecting ISO ports 104 and 105 with an RLC or equivalent non-reflective frequency selective filter. As will be understood by persons of ordinary skill in the art, a reflective filter, such as a Surface Acoustic Save filter, may be not preferable for implementing a frequency selective filter in place of the differential resistor 97 connecting ISO ports 104 and 105.

Example operations of this embodiment are described assuming, as an example, that the 90-degree hybrid couplers 96 and 98 are 50-Ω impedance couplers, meaning that they require a 50-Ω impedance termination for normal and symmetric operation. This is only one example impedance, selected to further assist in forming a clear understanding of this embodiment. Further, as known in the general arts pertaining to this invention, 50-Ω impedance is typical for symmetric 90-degree hybrid couplers.

Referring again to FIG. 10, it can be seen that any mismatch at the ISO ports 104 and 105 will cause the hybrid couplers 96 and 98 to have phase and magnitude imbalance. This will cause an increases impedance mismatch at the output ports 92 through 95 on the antenna side. The present inventors identified that replacing the resistive termination 97 of the present invention with a frequency selective filter permits exploitation of this mismatch, by increasing the impedance mismatch that out of band frequencies see at the output ports 92 through 95.

With continuing reference to FIG. 10, the frequency selective filter inserted in place of resistive termination 97 may be an RLC or equivalent non-reflective bandpass filter, centered at the operating mid-band frequency that is also the center of the narrowband antenna matching frequency. Continuing with the assumption that the 90-degree hybrid couplers 96 and 98 are 50-Ω impedance couplers, the phase shift feed according to FIG. 10, including the bandpass filter as the differential termination element in place of 97, are constructed and arranged to present, at the center frequency, a 50-Ω impedance to the ISO ports 104 and 105. At out of band frequencies the bandpass filter impedance changes to a different value, which causes the hybrid couplers 96 and 98 to create additional phase and amplitude imbalance, which itself reduces the antenna out of band efficiency. This causes a mismatch at the output ports 92-95, which further reduces the antenna out of band efficiency, which is the desired effect for interference rejection.

With continuing reference to FIG. 10, the frequency selective impedance connecting ISO ports 104 and 105 may have any conventional topology and may be implemented in any conventional technology, or any equivalent. Selection of the topology and technology is readily performed by persons of ordinary skill in the art based on the disclosure, applying conventional RF design criteria and methods. As illustrative examples, the frequency-selective impedance may be single-ended, differential, and may have lumped element, or stripline implementation.

Further, the present invention's arrangement of the frequency selective impedance (a filter) as a differential impedance between the ISO ports 104 and 105, instead of arranging a filter according to the prior art positioning at the ports 92 though 95, totally avoids the detrimental effect of the filter's very high in-band insertion loss (typically on the order of 0.5 to 3 dB). This embodiment therefore provides very significant improvement, both in filter cut-off performance and in-band insertion loss, over prior art phase shift antenna feeds with frequency selective filtering.

Referring to FIGS. 10 and 11, another embodiment of the invention may be implemented by removing the balun 100 and feeding input ports 103, 99 of 90-degree hybrid couplers 96 and 99 directly with an external differential feed. Typical RFIC chipsets have differential input with 180 degrees phase shift between the ports. This embodiment, by removing the balun 100, allows further size reduction of the feeding mechanism 20, which is a desired feature in minimizing the size of the antenna and its associated wireless device.

Tests of Constructed Samples

Figure 19:
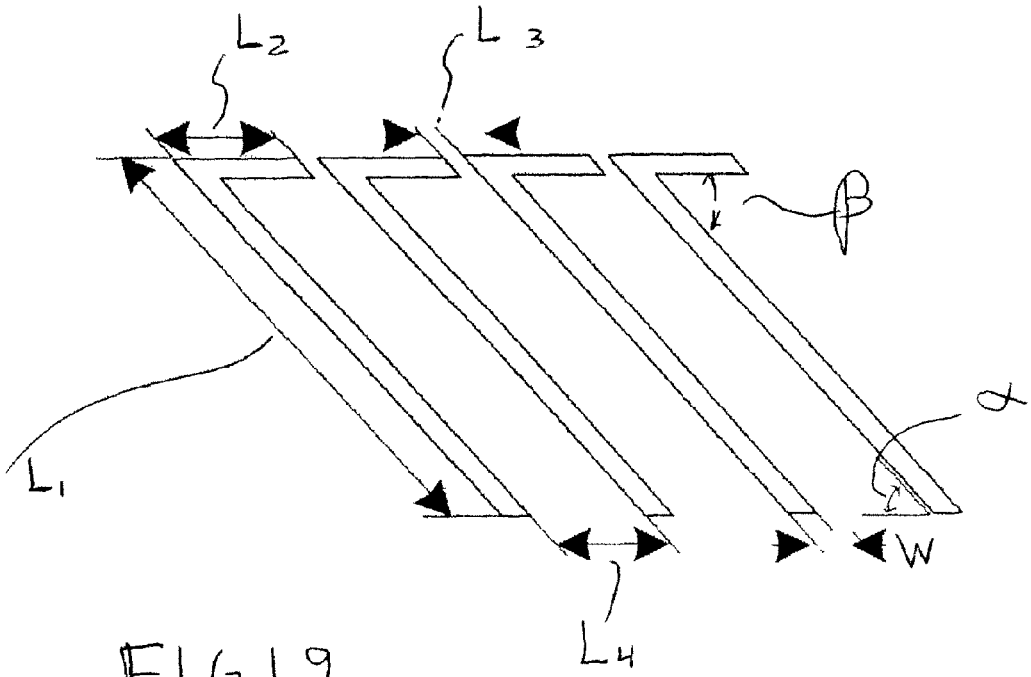
FIG. 19 shows the trace dimensions of one constructed broad band quadrifilar antenna having an embodiment of the invention, including L-shaped open circuit terminations.

An antenna according to FIGS. 6 and 7 was constructed and tested, with trace dimensions further labeled on FIG. 19 and having specific values stated below, with a phase shift feed with differential termination mechanism according to FIGS. 10 and 11. Referring to FIG. 6, the diameter D was 10.0 mm, the height H of the ceramic core was 19.4 mm and the height of the phase shift feed with differential termination was 0.6 mm phase shifter, for an overall height $H_T$ of 20 mm. Referring to FIG. 19, the copper trace dimensions were as listed in Table I.

TABLE I

| Copper Traces Specifications | |
|---|---|
| Item | |
| | Length [mm] |
| $L_1$ | 26.0 |
| $L_2$ | 5.6 |
| $L_3$ | 2.1 |
| $L_4$ | 6.2 |
| W | 1.5 |
| | Angle [degrees] |
| α | 48.0 |
| β | 48.0 |

The trace width W was uniform throughout $L_1+L_2$ length.

The material of the core 37 had a relative dielectric constant ($\in_r$) of 20. The chemical composition of the material was substantially CaMgTi. The unloaded quality factor ($Q_o$) at a specified frequency of 12 GHz was approximately 6000.

The radiating elements consisted of two materials that deposited to the core substrate. The silver deposit was placed first with 10-30 μm±5 μm thickness. The layer of copper was deposited on the silver layer with 3-6 μm+1 μm thickness.

The antenna input return loss was measured using an HP 8753D Vector Network Analyzer using HP 85046A S-Parameter Test Set. The antenna was connected to 50-ohm port 1 of S-Parameter Test Set through a 30-cm long 50-ohm coaxial cable. A Johanson Technology balun (1600BL15B100) was used.

Figure 20:
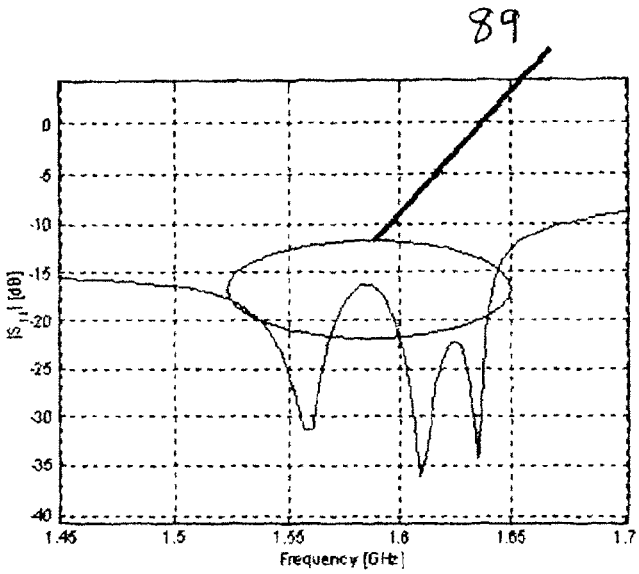
FIG. 20 shows one actual observed test measurement of antenna input return loss of one constructed broad band quadrifilar antenna having an embodiment of the invention, including L-shaped open circuit terminations.

FIG. 20 shows actual observed test measurement of the antenna input return loss of the constructed antenna.

The present inventors concluded, based on standard RF principles, that input return loss measurement values may, possibly, vary (either up or down) from those observed if balun other than the Johanson Technology balun (1600BL15B100) used in the measurement.

Antenna radiation patterns were measured using a 3-m SATIMO chamber in JEM Engineering facility (Laurel, Md.). The antenna was connected to the cable, which is connected to the receiver, loaded with ferrite beads to suppress the effects of the cable on the antenna measurements. The antenna was placed on a styrofoam platform of a particular height (about 1.5 m) to satisfy the phase center requirements in order to minimize the measurement errors. The antenna measurement location was at the antenna phase center location. The SATIMO chamber transmitters were stationary and consisted of wide-band horns placed in a circular fashion (elevation plane).

The antenna under test was rotated in an azimuth plane. Measurements were taken at the multiple frequencies in 1-MHz frequency steps. Both amplitude and phase data was recorded for full 3-D antenna pattern evaluation.

Figure 21:
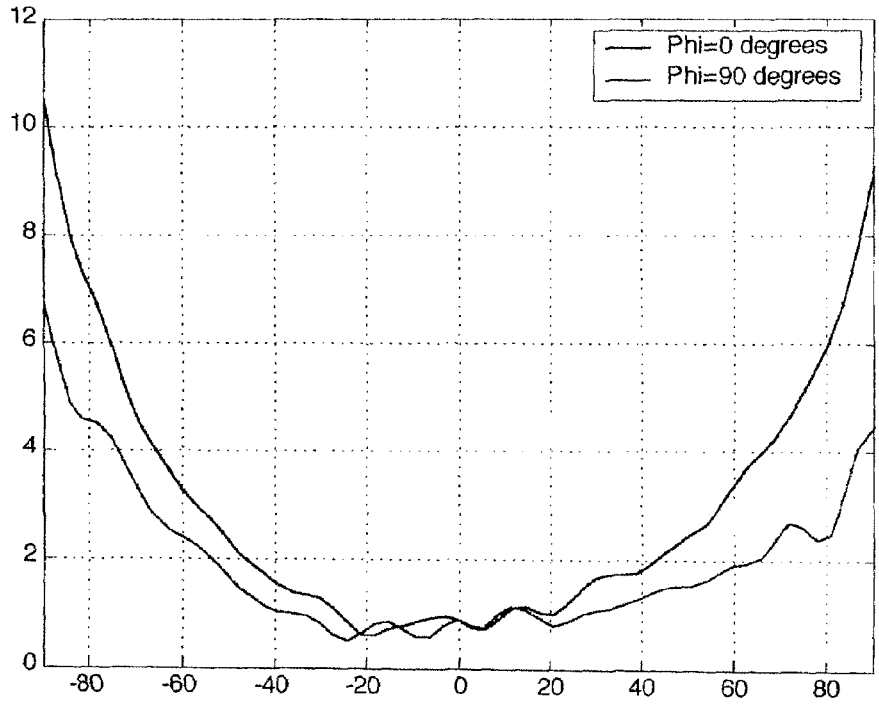
FIG. 21 shows a plot of actual observed test measured axial ratio data as a function of pattern angle for a constructed antenna according having described embodiments.

FIG. 21 shows actual observed test measurement data of the polarization and cross-polarization radiation pattern of the constructed antenna.

Figure 22:
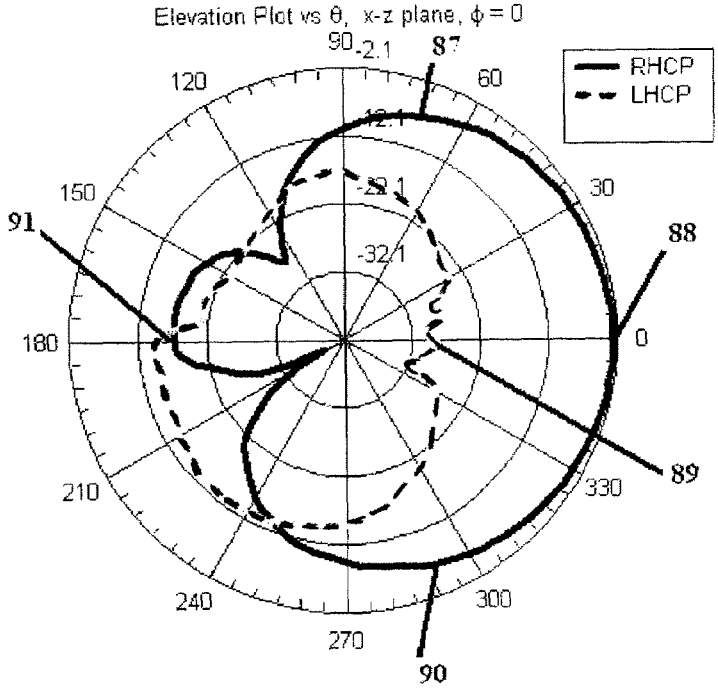
FIG. 22 shows one actual observed test measurement of a co-polarization and cross-polarization radiation pattern of one constructed broad band quadrifilar antenna having an embodiment of the invention, including L-shaped open circuit terminations.

FIG. 22 shows, in plot form, actual observed test measured axial ratio data as a function of pattern angle for the constructed antenna. As known in the art, axial ratio is an important measure of the antenna circular polarization purity and is directly related to the strength of the signal received. Referring to FIG. 22, the axial ratio data was shown for two principal antenna pattern cuts: phi=0 degrees (azimuth angle) vs. theta (elevation angle), and phi=90 degrees vs. theta.

As seen, the constructed antenna demonstrated an average axial ratio below 1 dB for over 80 degrees (theta −40 to 40 degrees) and better than 3 dB axial ratio over 120 degrees, in both principal planes. These performance values are much better than obtained with prior art QHA implementations.

While certain embodiments and features of the invention have been illustrated and described herein, many modifications, substitutions, changes, and equivalents will occur to those of ordinary skill in the art, and the appended claims cover all such modifications and changes as fall within the spirit of the invention.

We hereby claim:

1. A QHA antenna comprising:

a plurality of helical arms, each comprising a conductor extending a length in a helical winding direction about a longitudinal axis, each having a first distal end and a second distal end; and a differential termination phase shift feed network, having an input port, a first phase shift output port coupled to a first helical conducting arm, a second phase shift output port coupled to a second helical conducting arm, a third phase shift output port coupled to a third helical conducting arm, a fourth phase shift output port coupled to a fourth helical conducting arm, a first isolation port, a second isolation port, and a differential impedance element coupled between the first isolation port and the second isolation port, wherein the differential termination phase shift feed network further includes a first directional transmission path, having a first phase shift, from the input port to the first phase shift output port, a second directional transmission path, having a second phase shift, from the input port to the second phase shift output port, a third directional transmission path, having a third phase shift, from the input port to the third phase shift output port, and a fourth directional transmission path, having a fourth phase shift, from the input port to the fourth phase shift output port, and wherein the differential termination phase shift feed network further includes a first reverse directional path from the first phase shift output port to the first isolation port, a second reverse directional path from the second phase shift output port to the first isolation port, a third reverse directional path from the third phase shift output port to the second isolation port, and a fourth reverse directional path from the fourth phase shift output port to the second isolation port.

2. The QHA antenna of claim 1 where the differential impedance connected between the first isolation port and the second isolation port consists essentially of a resistive element.

3. The QHA antenna of claim 1 where the differential impedance connected between the first isolation port and the second isolation port consists essentially of a 50 ohm resistive element.

4. The QHA antenna of claim 1 wherein the differential impedance connected between the first isolation port and the second isolation port includes a reactive network.

5. The QHA antenna of claim 1 wherein the differential impedance connected between the first isolation port and the second isolation port consists essentially of a reactive network.

6. The QHA antenna of claim 1 wherein the differential impedance connected between the first isolation port and the second isolation port includes a network having a complex impedance.

7. The QHA antenna of claim 1 wherein the differential impedance connected between the first isolation port and the second isolation port includes a network having at least one resistive element having a resistance value and at least one reactive element having a reactive value, said resistance value and reactive value forming a complex impedance.

8. A method for tuning a QHA antenna, comprising:

providing a QHA having a plurality of helical arms;

providing a plurality of concurrently extant forward directional phase shifted transmission paths, each extending from a given antenna feed input port to a corresponding one of the plurality of helical arms, including providing a first forward transmission path, having a first phase shift, from an input port to a first phase shift output port of a first of the helical arms, a second forward transmission path, having a second phase shift, from the input port to a second phase shift output port of a second of the helical arms, a third forward transmission path, having a third phase shift, from the input port to a third phase shift output port of a third of the helical arms, and a fourth forward transmission path, having a fourth phase shift, from the input port to a third phase shift output port of a fourth of the helical arms;

providing a plurality of first directional reflection paths, extant concurrent with the plurality of directional phase shifted transmission paths, each extending from a different one among a first plurality of the helical arms to a first isolation port, including providing a first reverse directional path from the first phase shift output port to the first isolation port, a second reverse directional path from the second phase shift output port to the first isolation port;

providing a plurality of second directional reflection paths, extant concurrent with the plurality of directional phase shifted transmission paths and the plurality of first directional reflection paths, each extending from a different one among a second plurality of the helical arms to a second isolation port, including providing a third reverse directional path from the third phase shift output port to the second isolation port, and a fourth reverse directional path from the fourth phase shift output port to the second isolation port;

providing a differential termination impedance coupled between the first isolation port and the second isolation port;

feeding an externally generated feed signal to the antenna feed input port;

measuring a magnitude of a signal on the first isolation port and a magnitude of a signal on the second isolation port;

measuring a phase difference between a signal on the first isolation port and a signal on the second isolation port;

determining, based on the measuring of a magnitude and the measuring a phase difference, a tuning value of the QHA; and varying the differential termination impedance based on said tuning value.

9. The method of claim 8 wherein providing the differential impedance includes providing a network having at least one resistive element having a resistance value and at least one reactive element having a reactive value, and wherein said varying the differential termination impedance includes varying at least one of the resistive value and reactive value.

* * * * *